US009785120B2

(12) United States Patent
Westra et al.

(10) Patent No.: US 9,785,120 B2
(45) Date of Patent: Oct. 10, 2017

(54) WORLD WATCH

(71) Applicant: Simplify and Go, LLC, Chicago, IL (US)

(72) Inventors: Luke A. Westra, Chicago, IL (US); Dan Kraemer, Chicago, IL (US)

(73) Assignee: Simplify and Go, LLC, Chicago, IL (US)

( * ) Notice: Subject to any disclaimer, the term of this patent is extended or adjusted under 35 U.S.C. 154(b) by 0 days.

(21) Appl. No.: 14/881,950

(22) Filed: Oct. 13, 2015

(65) Prior Publication Data

US 2016/0103427 A1 Apr. 14, 2016

Related U.S. Application Data

(60) Provisional application No. 62/062,205, filed on Oct. 10, 2014.

(51) Int. Cl.
*G04B 19/22* (2006.01)
*G04G 9/00* (2006.01)

(52) U.S. Cl.
CPC ..... *G04G 9/0076* (2013.01); *G04B 19/22* (2013.01); *G04B 19/223* (2013.01)

(58) Field of Classification Search
CPC ..... G04B 19/22; G04B 19/223
See application file for complete search history.

(56) References Cited

U.S. PATENT DOCUMENTS 4,681,460 A 7/1987 Nishimura
4,847,819 A * 7/1989 Hong ..... G04B 19/223 368/21
4,945,521 A 7/1990 Klaus
5,237,544 A 8/1993 Sase et al.
5,294,097 A * 3/1994 Thomsen ..... F16F 1/10 185/45
5,982,710 A 11/1999 Rawat et al.
6,597,635 B2 * 7/2003 Dalloz ..... G04B 19/221 368/21
6,636,457 B2 10/2003 Lin
6,935,773 B2 8/2005 Speichinger et al.
7,050,357 B1 5/2006 Garcia
7,236,429 B2 * 6/2007 Yeh ..... G04B 19/223 368/21
8,036,066 B2 10/2011 Schlencker et al.
8,416,645 B2 4/2013 Zaugg et al.
2003/0112706 A1 6/2003 Dalloz
2006/0140056 A1 6/2006 Lizzi
2006/0171256 A1 * 8/2006 Herbert ..... G04C 17/0058 368/21
2009/0052284 A1 2/2009 Behling et al.
2010/0054088 A1 3/2010 Lin
2011/0032802 A1 2/2011 Muller et al.
2013/0343163 A1 12/2013 Beccia et al.

OTHER PUBLICATIONS

PCT Search Report and Written Opinion, PCT/US2015/00110, Date of mailing Dec. 29, 2015, 8 pages.

* cited by examiner

*Primary Examiner* — Vit W Miska

(74) *Attorney, Agent, or Firm* — Dicke, Billing & Czaja, PLLC

(57) ABSTRACT

A world watch capable of automatically adjusting displayed information otherwise indicating time of day around the world upon occurrence of a daylight savings time event.

20 Claims, 34 Drawing Sheets

DST 2013

JAN FEB MAR APR MAY JUN JUL AUG SEP OCT NOV DEC

USA & CANADA – MAR 10 / NOV 3

BRAZIL – OCT 20 / FEB 16

EUROPE – MAR 31 / OCT 26

NEW ZEALAND – SEP 29 / APR 7

AUSTRALIA – OCT 6 / APR 7

| | |
|---|---|
| -10 | **HONOLULU, HAWAII** |
| -9 | *ADAK, AK |
| | ANCHORAGE, AK |
| -8 | *ANCHORAGE, AK |
| | LOS ANGELES, CA |
| -7 | *LOS ANGELES, CA |
| | DENVER, CO |
| -6 | *DENVER, CO |
| | CHICAGO, IL |
| -5 | *CHICAGO, IL |
| | NEW YORK, NY |
| -4.5 | **CARACAS, VENEZUELA** |
| -4 | *NEW YORK, NY |
| | SAN JUAN PUERTO RICO |
| -3 | **BUENOS AIRES, ARGENTINA** |
| -2 | *RIO DE JANEIRO BRAZIL |
| | KING EDWARD POINT, SOUTH GEORGIA/SANDWICH IS. |
| -1 | **PRAIA, CAPE VERDE** |
| UTC | *REYKJAVIK, ICELAND |
| | LONDON, ENGLAND |
| +1 | *LONDON, ENGLAND |
| | PARIS, FRANCE |
| +2 | *PARIS, FRANCE |
| | CAIRO, EGYPT |
| +3 | **NAIROBI, KENYA** |
| +3.5 | **TEHRAN, IRAN** |
| +4 | **MOSCOW, RUSSIA** |
| +4.5 | **KABUL, AFGHANISTAN** |
| +5 | **KARACHI, PAKISTAN** |
| +5.5 | **MUMBAI, INDIA** |
| +6 | **DHAKA, BANGLADESH** |
| +6.5 | **YANGON, MYANMAR** |
| +7 | **BANGKOK, THAILAND** |
| +8 | **BEIJING, CHINA** |
| +9 | **TOKYO, JAPAN** |
| +9.5 | **DARWIN, AUSTRALIA** |
| +10 | *BRISBANE, AUSTRALIA |
| | SYDNEY, AUSTRALIA |
| +11 | *SYDNEY, AUSTRALIA |
| | NOUMEA, NEW CALEDONIA, FRANCE |
| +12 | **ANADYR, RUSSIA** |
| +13 | *AUCKLAND, NEW ZEALAND |
| | FUA'AMOTU, TONGA |

*DST

A64

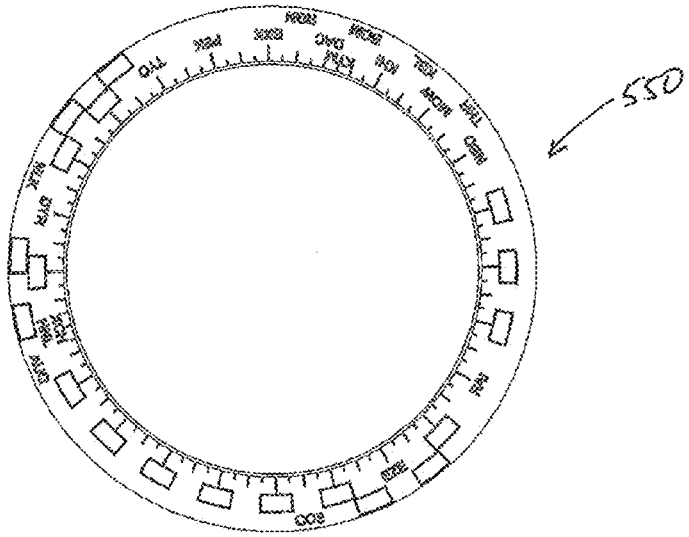
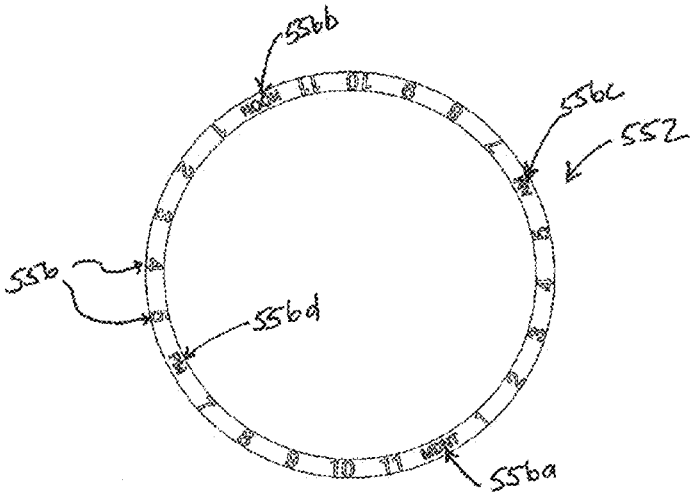
Fig. 22
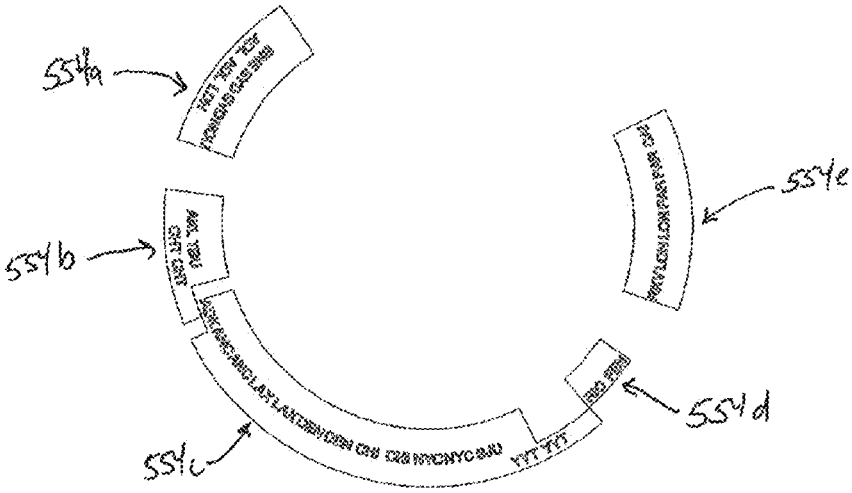

WORLD WATCH

CROSS REFERENCE TO RELATED APPLICATIONS

This Non-Provisional Patent Application claims the benefit of the filing date of U.S. Provisional Patent Application Ser. No. 62/062,205, filed Oct. 10, 2014, entitled "World Watch," which is herein incorporated by reference.

BACKGROUND

The present disclosure relates to watches (e.g., wristwatches) providing world-wide time information. More particularly, it relates to analog-type display watches providing a user with the ability to quickly determine the current time in any time zone in the world.

Frequent business travelers that visit various geographies struggle with the constant need to reset their watch or to use various time telling websites or apps to quickly check the current local time of various other locations. While attempts have been made to develop an analog-type watch (i.e., a circular, twelve hour clock display with hour and minute hands) that displays information indicative of the current time in multiple other locales, an easy-to-use and easily understood construction has not been achieved. The difficulties in devising a satisfactory watch design are not surprising given the complexities of time zone designations across the globe. As a point of reference, there are twenty-four official time zones in the world, each divided into units of one hour relative to the coordinated universal time (UTC). Additional, unofficial time zones that have been implemented in various locales set at a non-integer multiple of one hour (e.g., set an increment of a half-hour or quarter-hour relative to the UTC), bringing the total number of time zones to thirty-seven. These differences are desirably accounted for by the watch's display. Making the time difference calculation and display from one time zone to another even more difficult is the concept of daylight savings time. Different locales across the globe institute daylight savings at different times of the year (and yet other locales do not practice daylight savings). It is exceedingly difficult for an analog-type watch display to account for daylight savings time differences in multiple locales without requiring complicated mental calculations or manual intervention by the user.

For example, current multi-time zone watches exist that represent different time zones as multiple individual dials without indication of the location to which the display time is correlated to. Additionally, these watches required the user to manually set the time for each display, including making shifts for daylight savings time.

Other watches have taken the approach of providing a distinct interface displaying the name or abbreviation of the locale whose time is being displayed. The user sets the primary time zone by rotating a bezel in a setup mode of the watch to the correct city by aligning the city with a designated position and then inputting the current time. The user is then able to adjust the bezel to an alternate city, which causes a secondary hour hand on the watch to adjust to the current local time (hour) of the selected city. Even with watches of this type (preprogrammed time zone offsets), however, the user is still required to manually adjust the primary display for daylight savings time or at the very least manually activate a daylight savings time mode of operation.

In light of the above, a need exists for a world watch that displays current time information for multiple locales in an easy-to-understand format and that automatically accounts for daylight savings conventions in each region of interest.

BRIEF DESCRIPTION OF THE DRAWINGS

FIG. 4 is a chart providing global daylight savings time and UTC off-set information;

FIG. 22 is top plan exploded view of components useful with the watch of FIG. 18A;

DETAILED DESCRIPTION

Figure 1A:
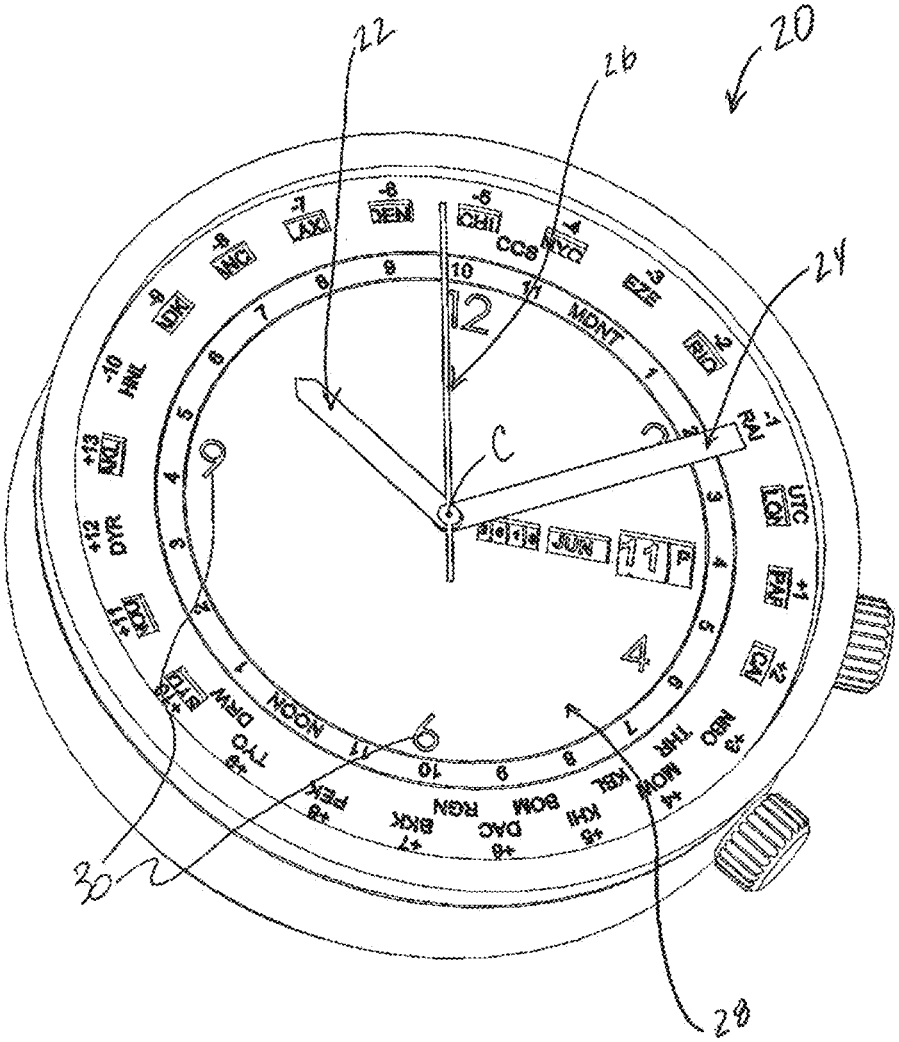
FIG. 1A is a perspective view of a world watch in accordance with principles of the present disclosure.
Figure 1B:
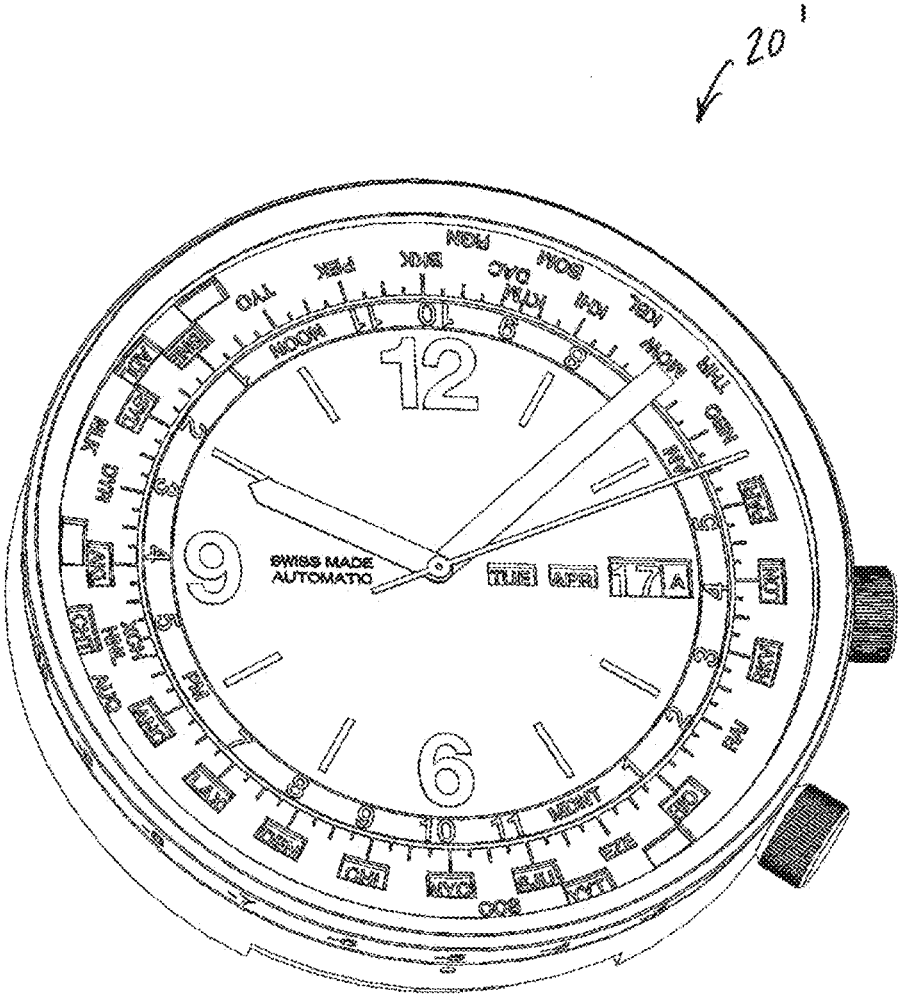
FIG. 1B is a perspective view of another world watch in accordance with principles of the present disclosure.

Aspects of the present disclosure relate to world watches configured to display current time information for multiple locales in an easy-to-understand format and that automatically accounts for daylight savings events or conventions in various regions or locales of interest. The world watches of the present disclosure can incorporate various display formats and/or mechanisms. By way of two non-limiting examples, one embodiment of a world watch 20 in accordance with principles of the present disclosure is shown in FIG. 1A, and a second embodiment world watch 20' is shown in FIG. 1B. The watches 20, 20' (as well as other world watch embodiment of the present disclosure) are similar in many respects, with the watch 20 formatted to display information indicative of twenty-four time zones and the watch 20' formatted to display information indicative of all thirty-seven time zones. These, and other time zone display formats can be incorporated into any of the watches of the present disclosure.

With specific reference to FIG. 1A, the watch 20 is generally configured to be highly portable, carried by a user in a conventional manner (e.g., wristwatch, pocket watch, etc.), and has an analog-type watch display including an hour hand 22, a minute hand 24, and a second hand 26. The hands 22-26 rotate about a common central axis C of the watch 20, as do several other components as described below. The hour and minute hands 22, 24 indicate current time to a user in a conventional manner via their relationship relative to a primary display 28, and in particular relative to conventional hour indicia 30 carried by the primary display 28. As a point of reference, in the view of FIG. 1A, the hour and minute hands 24 are arranged to indicate a current time of approximately 10:10. In addition, and as described in greater detail below, the watch 20 provides current date information and displays information indicative of the correct current time in a plethora of other locales (e.g., worldwide cites), adjusted for the differences in daylight savings time protocols (if any) implemented by the selected current locale of the user and the other locale(s) of interest as of the current date, in a manner that can quickly be determined by a user. As a point of reference, the watch 20 can include a locale or city selection indicator (described below) or the selected locale or city is optionally arranged at the twelve o'clock position by the user in the absence of a city selection indicator. Thus, selected city in the view of FIG. 1A is "CHI" (Chicago). While the watch 20 has a conventional analog-type display and incorporates various mechanical mechanisms (e.g., gears) for effectuating movement of various components, a digital controller is also included, programmed to control operation of the mechanisms in a predetermined fashion.

Figure 2:
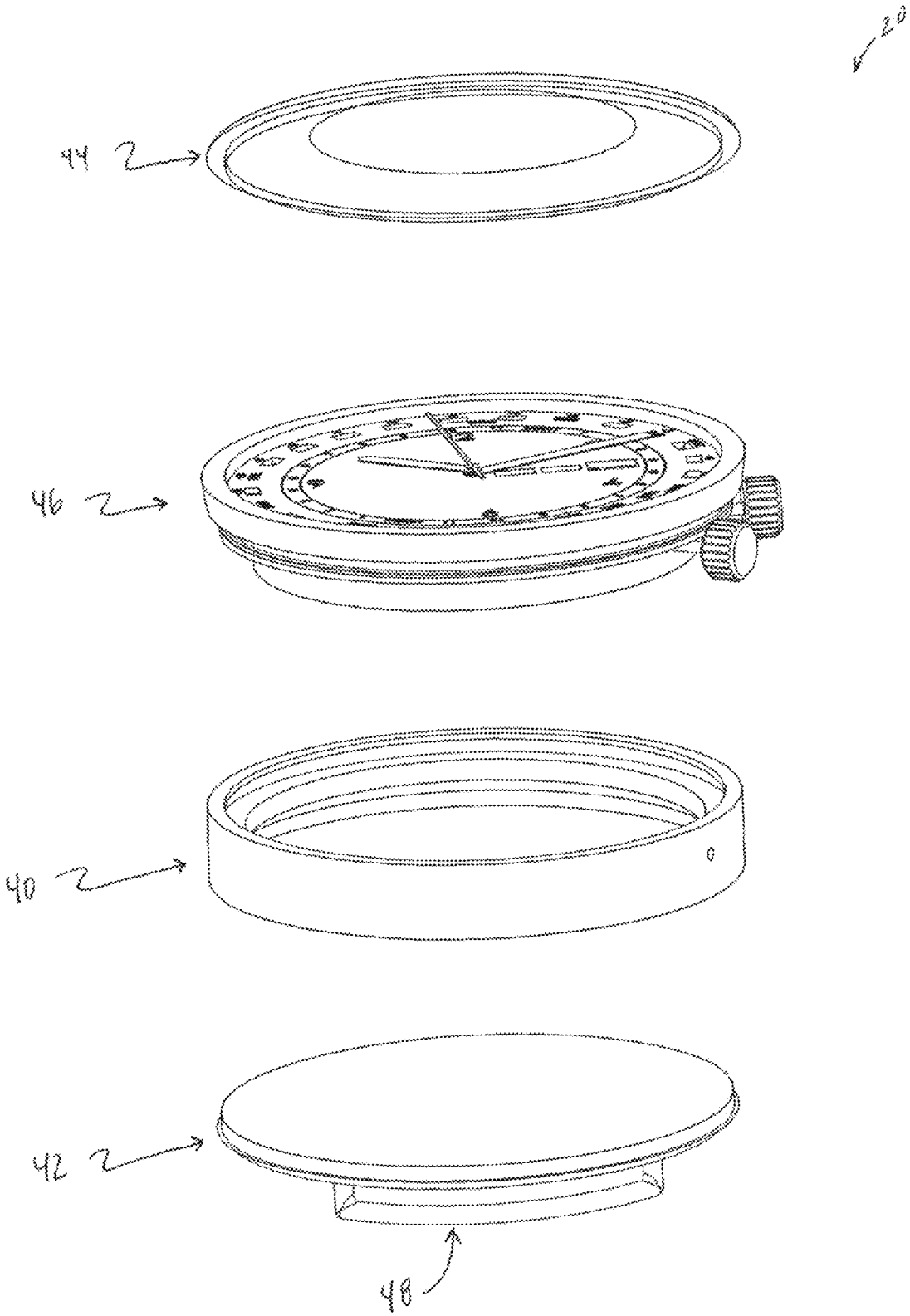
FIG. 2 is an exploded, perspective view of the watch of FIG. 1A.

In some embodiments, and as shown in FIG. 2, the watch 20 includes a case 40, a back cover 42, a front cover or glass 44 and a watch system 46. The case 40 is generally configured to receive and maintain the watch system 46, and can have a wide variety of shapes and sizes. In some embodiments, the case 40 is ring-shaped, forming various surface features configured to mate with corresponding features of the watch system 46 upon final construction. The back cover 42 is configured for assembly to the case 40, serving to protect the watch system 46. In some embodiments, the back cover 42 is removably coupled to the case 40 to facilitate user access to one or more components of the watch system 46 (e.g., a battery). One or both of the case 40 and the back cover 42 optionally includes one or more features that facilitate connection to one or more other components commonly associated with hand-held watches (e.g., a clasp 48 or similar structure for connection to a wristband). The front cover 44 is similarly configured for assembly to an opposite side of the case 40 and can be transparent or substantially transparent (e.g., glass) to facilitate user viewing of the watch system 46. It will be understood that the case 40, the back cover 42 and the front cover 44 can assume a wide variety of other forms that may or may not be directly implicated by the drawings.

Figure 3:
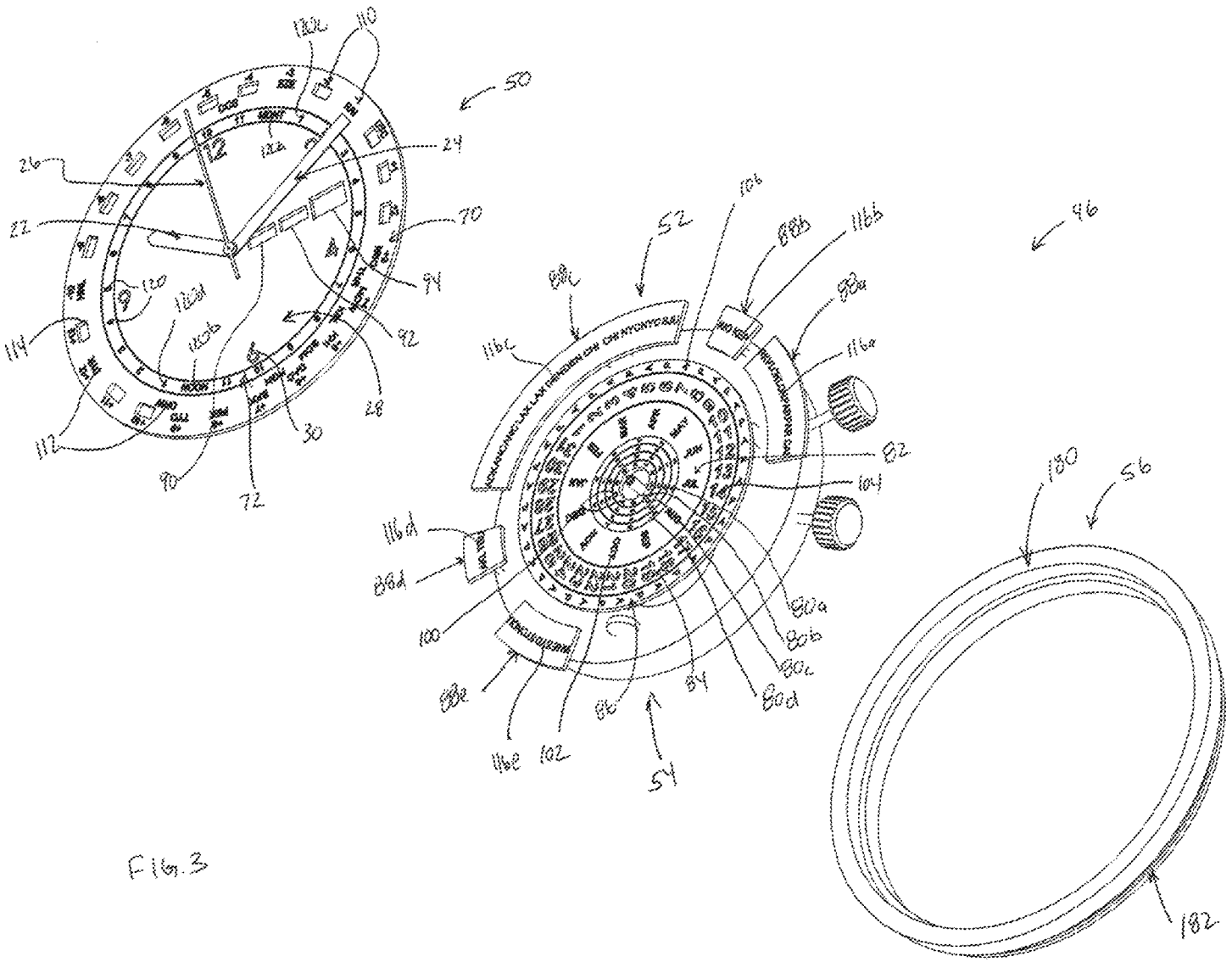
FIG. 3 is an exploded view of a watch system of the watch of FIG. 2.

In addition to the hands 22-26 and the hour indicia 30, the watch system 46 includes other display components intended to display information to a user, as well as mechanisms for controlling a relationship of the components relative to one another. For example, FIG. 3 illustrates the watch system 46 as including a front display assembly 50, a rear display assembly 52, a control assembly 54 and a bezel assembly 56. Details on the various components are provided below. In general terms, the front display assembly 50 displays various time and date related information to a user, with the so-displayed information being augmented by information provided by components of the rear display assembly 52 that otherwise underlies the front display assembly 50. The control assembly 54 dictates locations of various components of the front and rear display assemblies 50, 52 relative to one another, and includes both mechanical and logic components. Finally, the bezel assembly 56 maintains the front and rear display assemblies 50, 52, and serves as a user interface for selecting and displaying region(s) of interest.

For ease of explanation, it is useful to first identify major components of the front and rear display assemblies 50, 52. The front display assembly 50 includes, in some embodiments, the hands 22-26, the primary display 28, a first display ring 70, and a second display ring 72. The rear display assembly 52 includes optional first-fourth year rings 80*a*-80*d*, a month ring 82, a day ring 84, an AM/PM ring 86, and first-fifth partial city rings 88*a*-88*e*. In general terms, the year rings 80*a*-80*d* (where provided), the month ring 82, the day ring 84, and the AM/PM ring 86 correlate with the primary display 28, whereas the first-fifth partial city rings 88*a*-88*e* correlate with the first display ring 70.

As mentioned above, the primary display 28 can be akin to a conventional twelve hour clock face, and carries the hour indicia 30. The hour indicia 30 in some embodiments are arranged about a circular shape of the primary display 28 in a conventional twelve hour clock face fashion, but can also be arranged in a 24 hour clock face fashion, and can include one or more numbers typically associated with a clock (e.g., relative to the circular shape of the primary display 28, the hour indicia includes a "2" located at the two o'clock position, a "4" located at the four o'clock position, etc.). In addition, the primary display 28 forms or defines one or more apertures through a thickness thereof and through which date and other information carried by the rear display assembly 52 is visible. For example, the primary display 28 can form an optional year aperture 90, a month aperture 92, and a day aperture 94. The year aperture 90 (where provided) is sized and circumferentially located such that upon final assembly, sections of each of the first-fourth year rings 80*a*-80*d* are visible through the year aperture 90. In this regard, each of the year rings 80*a*-80*d* can carry number indicia 100 (referenced generally for the first year ring 80*a*), such as the numbers "0"-"9". The indicia 100 on each of the year rings 80*a*-80*d* is equidistantly spaced and arranged such that upon rotation of the year rings 80*a*-80*d* relative to the primary display 28, individual ones of the number indicia 100 carried by each of the year rings 80*a*-80*d* can be aligned with and visible through the year aperture 90 (e.g., in the view of FIG. 1A, the year rings 80*a*-80*d* are arranged relative to the year aperture 90 such that the number "2013" is collectively displayed and readily understood by a user as indicating the year 2013). In other embodiments, the year rings 80*a*-80*d*, and thus the year aperture 90, can be omitted.

The month aperture 92 is aligned with the year aperture 90, and is sized and circumferentially located such that upon final assembly, a section of the month ring 82 is visible through the month aperture 92. In this regard, the month ring 82 carries month indicia 102 (referenced generally) representative of each month of the year. The month indicia 102 can be abbreviations commonly understood for each month, or can take other forms that a user would understand to implicate a particular month of the year. Regardless, the month ring 82 is arranged relative to the primary display 28 such that with rotation of the month ring 82 relative to the primary display 28, individual ones of the month indicia 102 are aligned with and visible through the month aperture 92 (e.g., in the view of FIG. 1A, the month ring 82 is arranged relative to the month aperture 92 such that the month indicia "JUN" is displayed and readily understood by a user as indicating the month of June).

The day aperture 94 is aligned with the month aperture 92, and is sized and circumferentially located such that upon final assembly, a section of the day ring 84 is visible through the day aperture 94. In some embodiments, the day aperture 94 is further sized and arranged such that a section of the AM/PM ring 86 is also visible through the day aperture 94. In other embodiment, a separate aperture can be provided for the AM/PM ring 86. The day ring 84 carries day indicia 104 (referenced generally) typically in numeric form (e.g., the numbers "1"-"31"). The day ring 84 is arranged relative to the primary display 28 such that with rotation of the day ring 84 relative to the primary display 28, individual ones of the day indicia 104 are aligned with and visible through the day aperture 94 (e.g., in the view of FIG. 1A, the day ring 84 is arranged relative to the day aperture 94 such that the day indicia "11" is displayed and readily understood by a user as indicating the eleventh day of the month). The AM/PM ring 86 carries AM/PM indicia 106 (referenced generally) representative of AM or PM (e.g., the letters "A" and "P"). The AM/PM ring 86 is arranged relative to the primary display 28 such that with rotation of the AM/PM ring 86 relative to the primary display 28, individual ones of the AM/PM indicia 106 are aligned with and visible through the day aperture 94 (e.g., in the view of FIG. 1A, the AM/PM ring 86 is arranged relative to the day aperture 94 such that the AM/PM indicia "P" is displayed and readily understood by a user as indicating the displayed time of day (in the conventional twelve hour increment) is PM).

The first display ring 70 is sized and shaped to be concentrically located about the primary display 28 (with second display ring 72 disposed between the first display ring 70 and the primary display 28), and includes UTC off-set indicial 110, various city indicia 112, and apertures 114. The first-fifth partial city rings 88*a*-88*e* also carry city indicia 116*a*-116*e*, and are sized and shaped such that upon final assembly below the first display ring 70, selective ones of the individual city indicia 116*a*-116*e* are selectively aligned with and visible through respective ones of the apertures 114.

Arrangement of the particular city indicia 112 on the display ring relative to the particular UTC off-set indicia 110 as well as the particular city indicia 116*a*-116*e* displayed on each of the first-fifth partial city rings 88*a*-88*e* are premised upon various time zone locale groupings around the globe. As a point of reference, FIG. 4 illustrates daylight savings time protocols (for the year 2013) for common groupings of locales around the world, as well as the UTC off-set for multiple different locales of interest. For example, 2013 daylight savings time for the United States and Canada began Mar. 10, 2013 and ended Nov. 3, 2013, whereas Australia began on Oct. 6, 2013 and ends Apr. 7, 2014. It will be understood that different locales within each region may or may not adhere to the assigned daylight savings time protocol (e.g., in the United States, Hawaii and most of Arizona do not observe daylight savings time). Where followed, daylights savings entails a one-hour forward time shift at the start of the daylight savings time period and a one-hour backward time shift at the end of the daylight savings time period. The procedure by which daylight savings time is implemented can vary from region-to-region. For example, in the United States, the one-hour time shift occurs at 02:00 local time (i.e., 2:00 AM local time), whereas the European Union all shifts at 01:00 UTC (i.e., 1:00 AM UTC). Though complex, the daylight savings time protocols around the globe are well established.

The UTC off-set information reflected by FIG. 4 is also well established, and reflects not only the difference or off-set (in hours) of each listed locale relative to UTC (e.g., Buenos Aires, Argentina has a UTC off-set of "−3" meaning that Buenos Aires is three hours "behind" UTC; in other words, at 05:00 (or 5:00 AM) UTC, it is 02:00 (or 2:00 AM) in Buenos Aires), but also that many of the listed locales do not follow daylight savings time. These locales are shown with bold letters in FIG. 4. For the listed locales that do follow daylight savings time, the UTC off-set designations reflect that the UTC off-set applicable to a particular locale differs depending upon whether or not daylight savings time is in effect (e.g., Sydney, Australia has a UTC off-set of "+10" hours when daylight savings time is not in effect, and a UTC off-set of "+11" hours when daylight savings time is in effect).

Figure 5A:
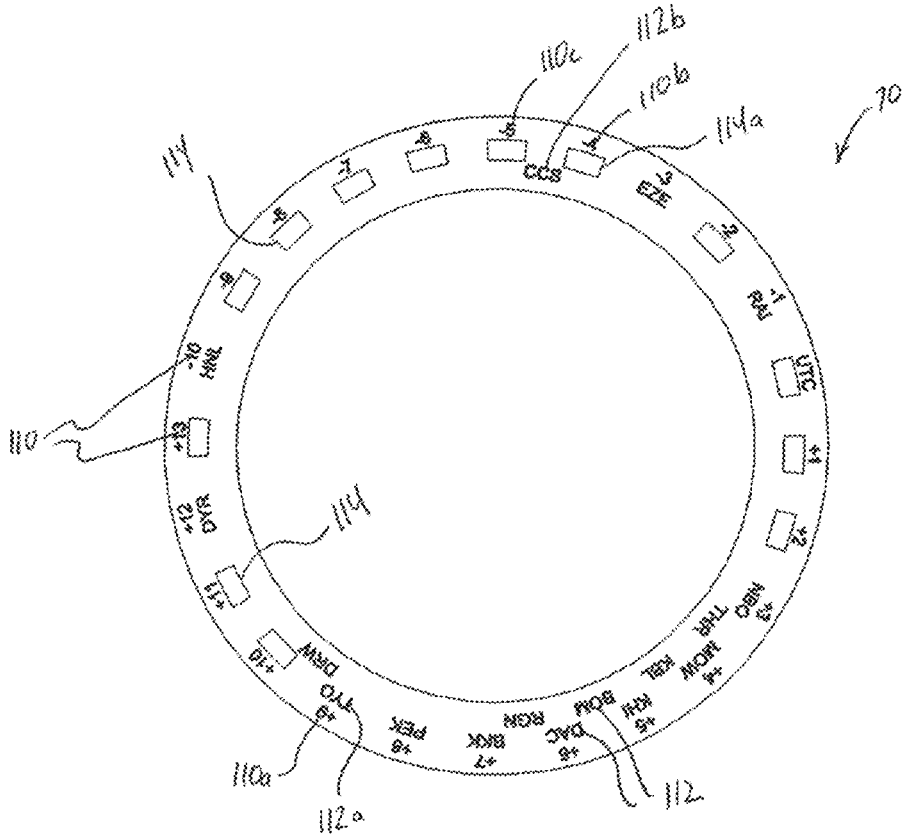
FIG. 5A is a front view of a first display ring component of the watch system of FIG. 3.

With the above time zone groupings and UTC off-set conventions in mind, the first display ring 70 is shown in greater detail in FIG. 5A. The UTC off-set indicia 110 follows the circular shape of the first display ring 70, and includes "UTC" and sequentially arranged (relative to the "UTC" designation) negative/positive integers that represent off-sets relative to UTC (i.e., "−10" through "−1" and "+1" through "+13"). The city indicia 112 includes a number of different city or other locale abbreviations that are each strategically arranged relative to selected ones of the UTC off-set indicia 110, directly implicating the UTC off-set assigned to the city/locale. For example, the UTC off-set indicia 110 includes "+9" (identified at 110*a*) and the city indicia 112 includes "TYO" (identified at 112*a*). The TYO city indicia 112*a* is aligned with the +9 UTC off-set indicia 110*a*. "TYO" is a well understood abbreviation for the city of Tokyo, Japan. Thus, because "TYO" is aligned with "+9", a viewer readily understands that Tokyo has a +9 hour off-set relative to UTC (i.e., that Tokyo is 9 hours "ahead" of UTC). By way of further example, the UTC off-set indicia 110 further includes "−4" (identified at 110*b*) and "−5" (identified at 110*c*), and the city indicia 112 includes "CCS" (identified at 112*b*). The CCS city indicia 112*b* is aligned between the −4 and −5 UTC off-set indicia 110*b*, 110*c*. "CCS" is a well understood abbreviation for the city of Caracas, Venezuela. Thus, because "CCS" is aligned between "−4" and "−5", a viewer readily understands that Caracas has a −4.5 hour off-set relative to UTC (i.e., that Caracas is 4.5 hours "behind" UTC). The cities or other locales represented by these and other city indicia 112 shown on the first display ring 70 are those that do not follow daylight savings time protocols and thus the UTC off-set for each city/locale will not change (as compared to cities/ locales that do follow a daylight savings procedure as described above). Thus, the city indicia 112 can be "permanently" displayed relative to the UTC off-set indicia 110 along the first display ring 70. The present disclosure is in no way limited to the city indicia 112 shown. Other cities or locales (that do not otherwise follow daylight savings time) can be included with the city indicia 112, other abbreviation formats can be employed, etc.

Figure 5B:
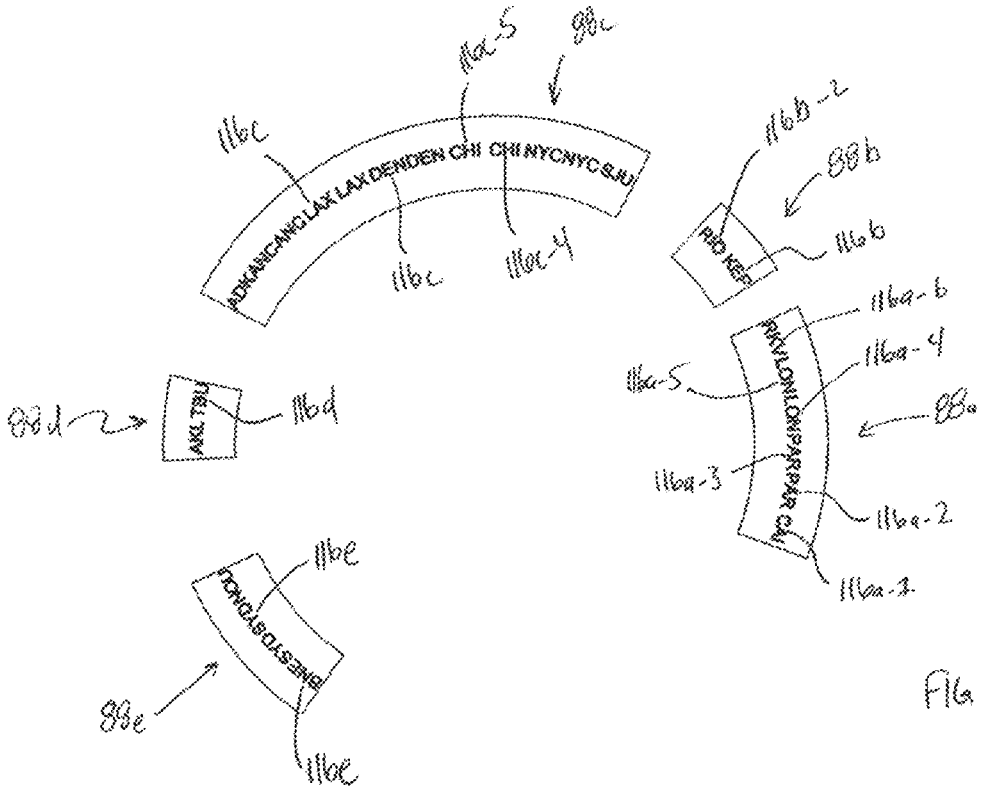
FIG. 5B is a front view of partial city ring components of the watch system of FIG. 3.

Respective ones of the apertures 114 are aligned with certain ones of the UTC off-set indicia 110. For example, a first aperture 114*a* is aligned with the "−4" UTC off-set indicia 110*b*. The apertures 114 are each sized and circumferentially located such that upon final assembly, a section of a respective one of the first-fifth partial city rings 88*a*-88*e* (FIG. 3) is visible through the corresponding aperture 114. With this in mind, the first-fifth partial city rings 88*a*-88*e* are shown in greater detail in FIG. 5B. The city indicia 116*a*-116*e* includes a number of different city or other locale abbreviations, with the city indicia 116*a*-116*e* carried by the corresponding first-fifth partial city ring 88*a*-88*e* representing a grouping of geographically close (in terms of time zone) cities/locales that each follow a daylight savings time protocol. For example, the city indicia 116*a* of the first partial city ring 88*a* includes "CAI" (identified at 116*a*-1), a first "PAR" 116*a*-2, a second "PAR" 116*a*-3, a first "LON" 116*a*-4, a second "LON" 116*a*-5, and "RKV" 116*a*-6. The designations 116*a*-1-116*a*-6 are well understood abbreviations for the cities of Cairo, Paris, London, and Reykjavik, respectively, and is each sized to be displayed through a corresponding one of the apertures 114 in the first display ring 70. The city indicia 116*a* optionally includes redundant city/locale designations (e.g., the two "PAR" 116*a*-2, 116*a*-3 and the two "LON" 116*a*-4, 116*a*-5) for reasons made clear below. The cities implicated by the city indicia 116*b*-116*e* of the remaining partial city rings 88*b*-88*e* can follow a similar format (i.e., common grouping of cities/locales following daylight savings time and geographically proximate one another at least in terms of time zone), with some abbreviations being repeated for reasons made clear below.

Figure 6A:
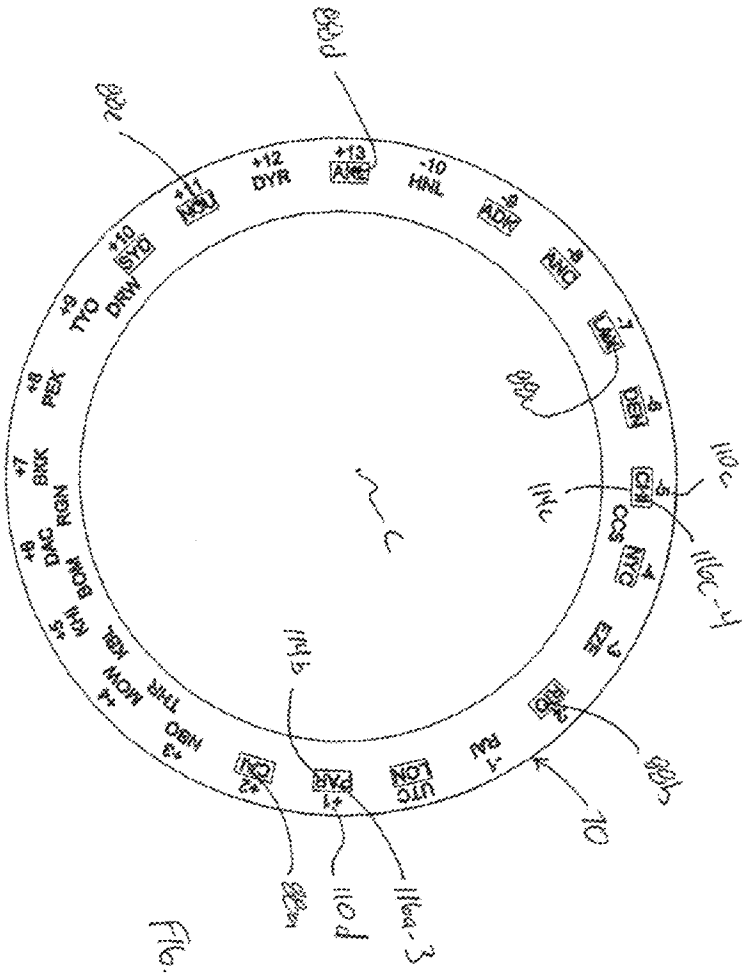
FIGS. 6A and 6B are front views of the first display ring of FIG. 5A located over the partial city rings of FIG. 5B and at different rotational arrangements.

Upon final assembly, the partial city rings 88*a*-88*e* underlie the first display ring 70, arranged such that selected ones of the city indicia 116*a*-116*e* are visible through a corresponding one of the apertures 114. By rotating the first display ring 70 relative to one or more or all of the partial city rings 88*a*-88*e* and/or by automated rotation of one or more of all of the partial city rings 88*a*-88*e* relative to the first display ring 70, the particular city indicia 116*a*-116*e* visible through one or more or all of the apertures 114 will change. For example, FIG. 6A illustrates one possible arrangement of the first display ring 70 relative to the partial city rings 88*a*-88*e* (it being understood that the partial city rings 88*a*-88*e* are primarily hidden behind the first display ring 70 in the view of FIG. 6A and are thus referenced generally). The partial city rings 88*a*-88*e* are arranged relative to the first display ring 70 such that a selected one of the city indicia 116*a*-116*e* is visible through respective ones of the apertures 114, and the so-displayed city indicia is aligned with a corresponding one of the UTC off-set indicia 110. For example, the first partial city ring 88*a* is arranged relative to the first display ring 70 such that the second "PAR" city indicia 116*a*-3 is visible through a second aperture 114*b* otherwise aligned with a "+1" UTC off-set indicia 110*d*. A viewer readily understands this arrangement or display to indicate that Paris currently has a +1 hour off-set relative to UTC (i.e., that Paris is one hour "ahead" of UTC). The third partial city ring 88*c* is arranged relative to the first display ring 70 such that a first "CHI" city indicia 116*c*-4 (also identified in FIG. 5B) is visible through a third aperture 114*c* otherwise aligned with the "−5" UTC off-set indicia 110*c*. A viewer readily understands this arrangement or display to mean that Chicago currently has a −5 hour off-set relative to UTC (i.e., that Chicago is currently five hours "behind" UTC).

Figure 6B:
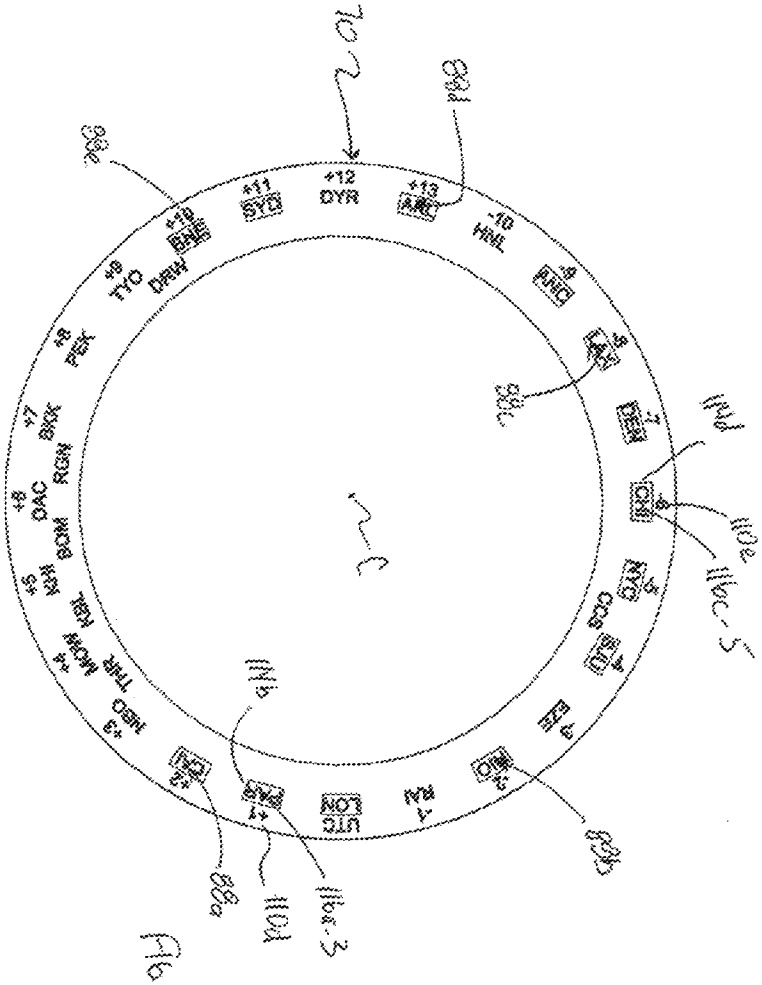

FIG. 6B illustrates a second possible arrangement of the first display ring 70 relative to the partial city rings 88*a*-88*e* (that again are primarily hidden in the view of FIG. 6B). As compared to the arrangement of FIG. 6A, the third and fifth partial city rings 88*c*, 88*e* have moved or rotated (about the central axis C) relative to the first display ring 70, whereas a relationship between the first, second and fourth partial city rings 88*a*, 88*b*, 88*d* relative to the first display ring 70 has not changed. The change in relationship between the third and fifth partial city rings 88*c*, 88*e* relative to the first display ring 70 can be accomplished by moving the first display ring 70 and/or moving the third and fifth partial city rings 88*c*, 88*e* relative to one another. In the view of FIG. 6B, the third partial city ring 88*c* is arranged relative to the first display ring 70 such that a second "CHI" city indicia 116*c*-5 (also identified in FIG. 5B) is visible through a fourth aperture 114*d* otherwise aligned with a "−6" UTC off-set indicia 110*e*. A viewer readily understands this arrangement or display to mean that Chicago currently has a −6 hour off-set relative to UTC (i.e., that Chicago is currently six hours "behind" UTC). Notably, a relationship between the first partial city ring 88*a* and the first display ring 70 has not changed between the views of FIGS. 6A and 6B; thus, in the view of FIG. 6B, the second "PAR" city indicia 116*a*-3 remains aligned with and visible through the second aperture 114*b* otherwise aligned with the "+1" UTC off-set indicia 110*d*. Again, a viewer readily understands this arrangement or display to indicate that Paris currently has a +1 hour off-set relative to UTC (i.e., that Paris is currently one hour "ahead" of UTC).

Returning to FIG. 3, the second display ring 72 is concentrically disposed between the primary display 28 and the first display ring 70, with the second display ring 72 being rotatable relative to the primary display 28 and the first display ring 70. The second display ring 72 carries or displays hour indicia 120, consisting of numbers or letters that collectively represent a twenty-four hour day in sequential order. In some embodiments, the hour indicia 120 includes differentiators between midnight and noon (e.g., "MDNT" hour indicia 120*a* and "NOON" hour indicia 120*b*), with consecutive numbers 1-11 between the MDNT and NOON representing the hours between midnight and noon (e.g., the hour indicia 120 includes the number "1" (identified at 120*c*) immediately adjacent (in the clockwise direction) the "MDNT" hour indicia 120*a* and is thus readily understood to represent 1:00 AM; a second number "1" (identified at 120*d*) is displayed immediately adjacent (in the clockwise direction) the "NOON" hour indicia 120*b* and is thus readily understood to represent 1:00 PM). Depending on the mechanism employed, the direction of rotation may change and require the adjacent numbers to be incremented in the counter-clockwise direction. The hour indicia 120 can also assume a variety of other forms.

Figure 7:
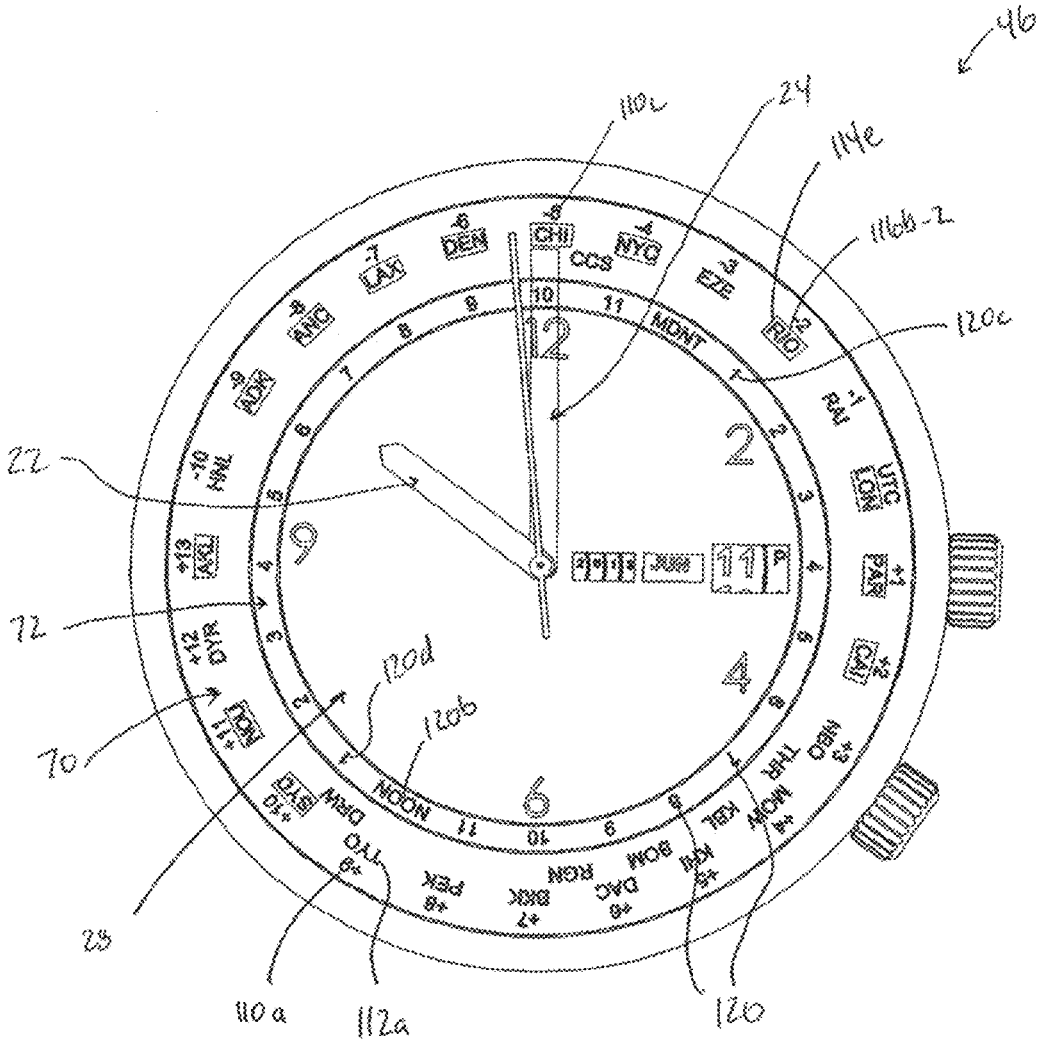
FIG. 7 is a front view of the watch of FIG. 1A and illustrating a second display ring.

The second display ring 72, and in particular the hour indicia 120 carried thereby, allows a viewer of the watch assembly 46 to more quickly determine the current time in various locales around the globe without changing the current selected city or the primary display 28 time. For example, and with reference to FIG. 7, the hour and minute hands 22, 24 are arranged relative to the primary display 28 to indicate a current time of 10:00; the AM/PM indicia 106 visible at the primary display 28 is "P", thus confirming that the current time is 10:00 PM. With this in mind, the hour indicia 120 of the second display ring 72 is generally aligned with locales displayed at or through the first display ring 70, thus informing a viewer as to the corresponding current time in the displayed locales. For example, the "NOON" hour indicia 120*b* is generally aligned with the "TYO" city indicia 112*a*, readily informing a viewer that the current time in Tokyo is 12:00 noon. Notably, a viewer could alternatively calculate the current time in Tokyo by noting the "−5" UTC off-set indicia 110*c* associated with the city to which the watch has been set as mentioned above (Chicago), and the "+9" UTC off-set indicia 110*a* associated with Tokyo. Comparing these two UTC off-set values, a viewer is readily informed that Tokyo is 14 hours ahead of the locale to which the watch has been set; thus, adding 14 hours to the displayed current time of 10:00 PM results in 12:00 noon in Tokyo. The second display ring 72 allows the viewer to more quickly ascertain this same information. By way of further example, the "1" (AM) hour indicia 120*c* is generally aligned with the "RIO" city indicia 116*b*-2 (also identified in FIG. 5B) that is otherwise visible through a fifth aperture 114*e*, readily informing a viewer that the current time in Rio de Janeiro is 1:00 AM.

Figure 8:
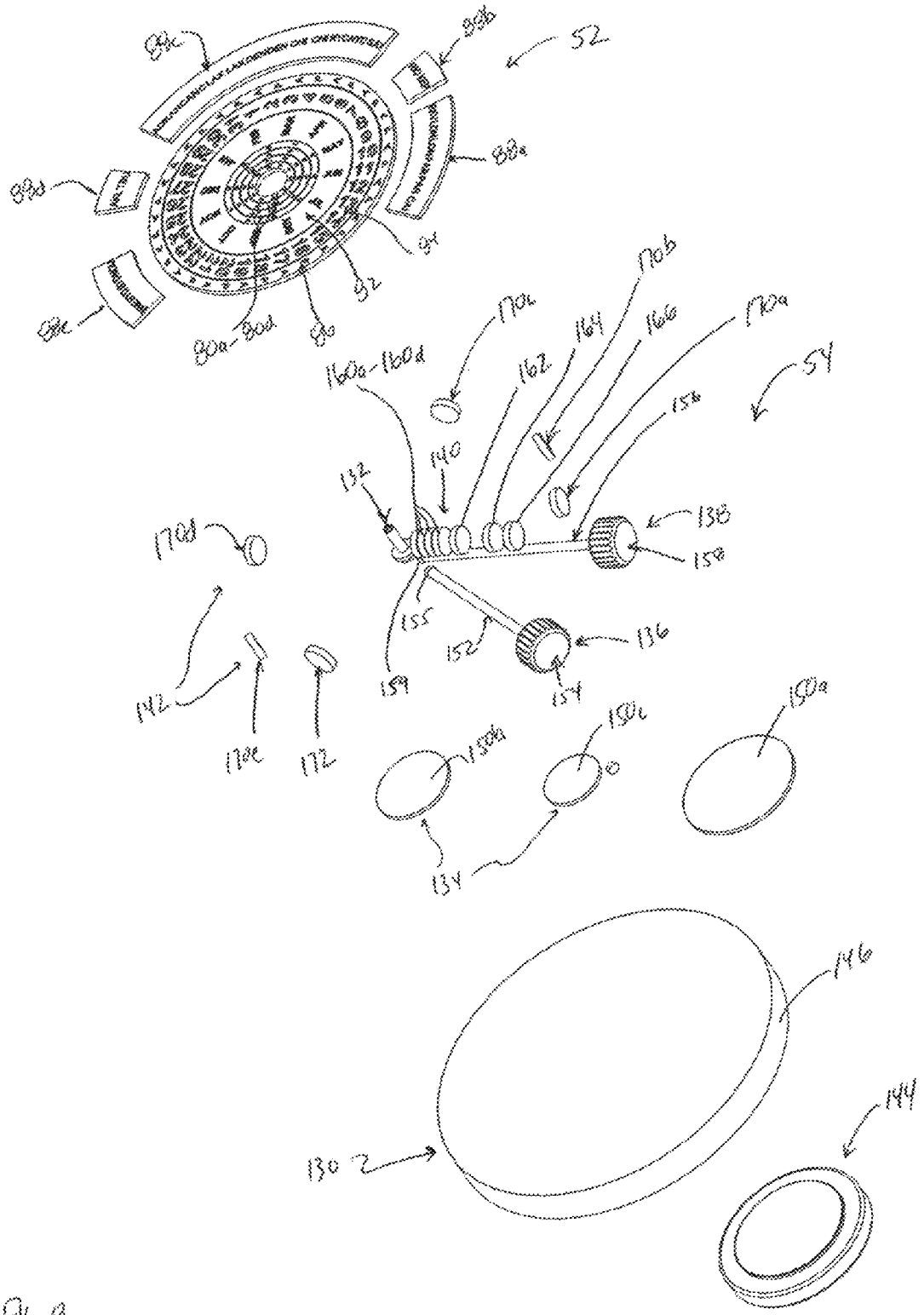
FIG. 8 is an exploded view of a control assembly of the watch system of FIG. 3 along with a rear display assembly.

Returning to FIG. 3, the control assembly 54 is operable to control movement of the rear display assembly 52 components as well as components of the front display assembly 50 (apart from the primary display 28), and can assume a wide variety of forms. In general terms, the control assembly 54 can include various gears, linkages, springs, or other mechanisms configured to interface with the front and rear display assemblies 50, 52 in a predetermined, controlled manner. For example, one embodiment of the control assembly 54 is shown in greater detail in FIG. 8 (along with components of the rear display assembly 52). The control assembly 54 can include a movement sub-assembly 130 (drawn schematically in block form), a hand drive sub-assembly 132, movement couplers 134 (referenced generally), a time set post 136, a date set post 138, set gears 140 (referenced generally), control gears 142 (referenced generally), and a power supply 144. In general terms, the hand drive assembly 132 dictates movement of the hour, minute, and second hands 22-26 (FIG. 1A), with operation of the hand drive assembly 132 being controlled by the movement sub-assembly 130 via the movement couplers 134. The time set post 136 via affords user control over an arrangement of the hour and minute hands 22, 24, whereas the date set post 138 affords user control of the displayed date (and optionally AM/PM) via the set gears 140. The control gears 142 interface with corresponding components of the rear display assembly 52, with movement of the control gears 142 being dictated by the movement sub-assembly 130. Finally, the power supply 144 (e.g., a battery or mechanical power/energy source such as a spring system as known to those skilled in the art of watch making) provides power to the movement sub-assembly 130.

The movement sub-assembly 130 includes conventional watch components and mechanisms (e.g., gears, springs, pawls, levers, etc.) known in the art for operating a watch. For example, the movement sub-assembly 130 can include an off-the-shelf watch control assembly available from ETA SA Swiss Watch Manufacturer of Grenchen, Switzerland. In addition, the movement sub-assembly 130 includes a controller apparatus 146 (referenced generally). The controller 146 can be any form of mechanical, digital or computer-type controller (e.g., a programmable logic controller) that optionally includes a memory and is programmed (or programmable) to prompt movement of the gears 140, 142. Programmed information or operational routines stored by the controller 146 are described in greater detail below. Such control mechanisms can also employ standard timing control components such as quartz crystals with electromagnetic output or purely mechanical elements.

The hand drive assembly 132 can also be of a conventional design commonly used with watches, and includes drive shafts or pins that are configured to be individually linked to respective ones of the hands 22-26 (FIG. 1A), along with individual gears linked to respective ones of the drive shafts. The gears, in turn, are linked to the movement couplers 134 that are configured for connection to corresponding mechanisms (not shown) provided with the movement sub-assembly 130 such that the movement sub-assembly 130 controls movement of the hands 22-26 via the hand drive assembly 132. As with other mechanisms associated with the control assembly 54, the movement couplers 134 can assume a wide variety of forms as is readily apparent to one of skill. In some embodiments, the movement couplers 134 can include an hour hand coupler 150*a*, a minute hand coupler 150*b*, and a second hand coupler 150*c*.

The time set post 136 is of a conventional type, and includes a shaft 152 and a crown 154. The shaft 152 is sized and shaped to interface with (e.g., with rotation of the shaft 152) one or both of the movement sub-assembly 130 (via one or more mechanisms (not shown) provided with the movement sub-assembly) and the movement couplers 134, for example at an end 155 of the shaft 152. The crown 154 is attached to the shaft 152 and is configured to facilitate user actuation (e.g., pulling and/or rotation) of the time set post 136.

The date set post 138 is of a conventional type, and includes a shaft 156 and a crown 158. The shaft 156 is sized and shaped to interface with (e.g., with rotation of the shaft 152) one or both of the movement sub-assembly 130 (via one or more mechanisms (not shown) provided with the movement sub-assembly 130) and the set gears 140, for example at an end 159 of the shaft 156. The crown 158 is attached to the shaft 156 and is configured to facilitate user actuation (e.g., pulling and/or rotation) of the date set post 138.

The set gears 140 include first-fourth year gears 160*a*-160*d*, a month gear 162, a date gear 164 and an AM/PM gear 166. The first-fourth year gears 160*a*-160*d* are configured to interface with corresponding ones of the first-fourth year rings 80*a*-80*d* such that rotation of the year gear 160*a*-160*d* prompts rotation of the corresponding year ring 80*a*-80*d*. The month gear 162 has a similar relationship with the month ring 82, as does the date gear 164 with the date ring 84, and the AM/PM gear 166 with the AM/PM ring 86. A wide variety of other mechanical and/or electromechanical components can alternatively be employed to control movement of one or more of the year rings 80*a*-80*d*, the month ring 82, the date ring 84 and/or the AM/PM ring 86. Regardless, the set gears 140 (or other device) are each linked, directly or indirectly, to the movement sub-assembly 130 and the date set post 138 for reasons made clear below.

The control gears 142 include first-fifth city gears 170*a*-170*e* and a second display ring gear 172. The first-fifth city gears 170*a*-170*e* are configured to interface with corresponding ones of the first-fifth partial city rings 88*a*-88*e* such that rotation of the city gear 170*a*-170*e* prompts movement (i.e., rotation about the central axis C (FIG. 1A) of the watch assembly 46) of the corresponding partial city ring 88*a*-88*e*. The second display ring gear 172 has a similar relationship with the second display ring 72 (FIG. 3). A wide variety of other mechanical components can alternatively be employed to control movement of one or more of the partial city rings 88*a*-88*e* and/or the second display ring 72. Regardless, the control gears 142 (or other device) are each linked, directly or indirectly, to the movement sub-assembly 130 for reasons made clear below.

Figure 9A:
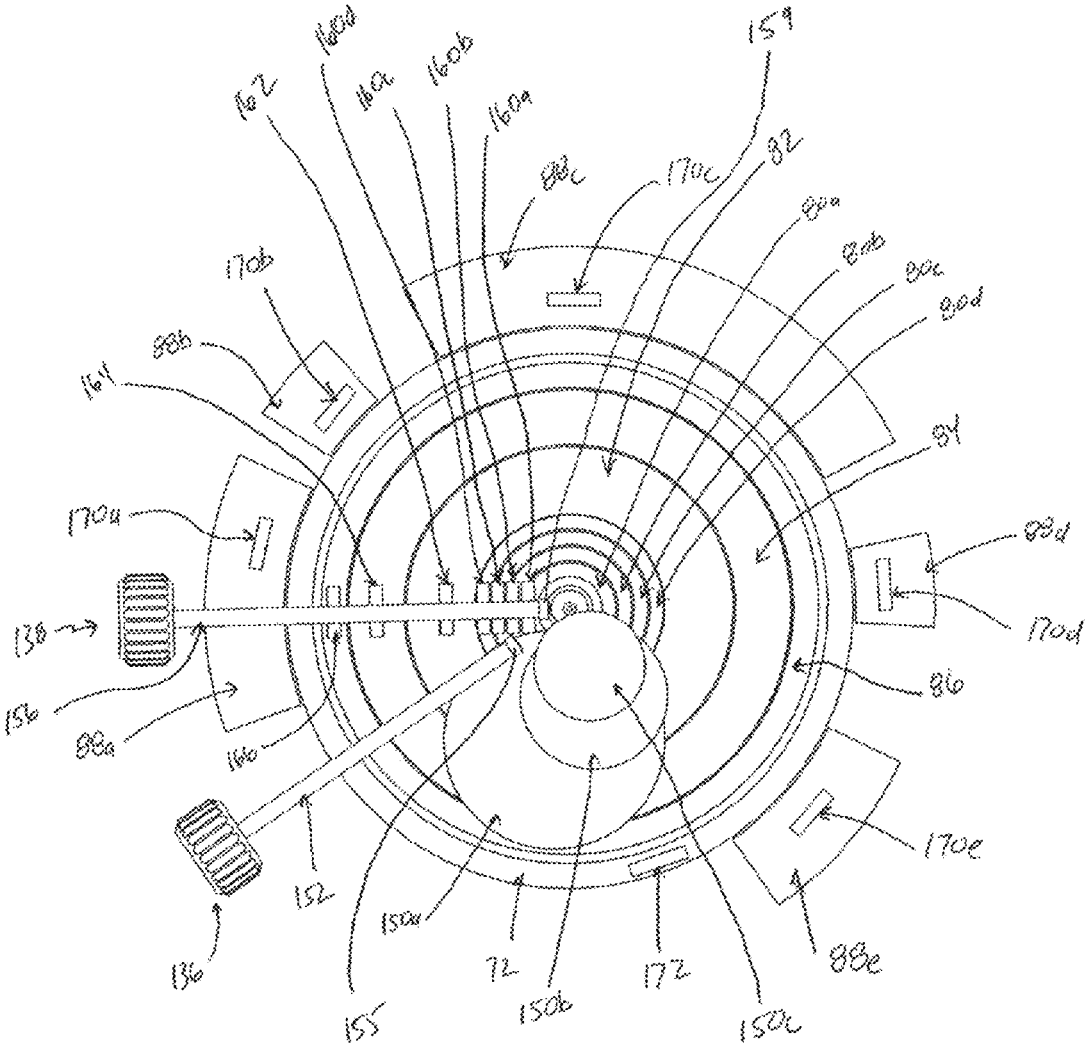
FIG. 9A is a rear view of the control assembly of FIG. 9 assembled to the rear display assembly.

Arrangement of components of the control assembly 54 relative to the rear display assembly 52 and the second display ring 72 is illustrated in FIG. 9A (in which the movement sub-assembly 130 and the power source 144 are removed for ease of understanding). Each of the first-fifth city gears 170*a*-170*e* is connected to or meshes with a respective one of the first-fifth partial city rings 88*a*-88*e* (e.g., each of the first-fifth partial city rings 88*a*-88*e* forms a toothed back surface (not shown) that meshes with teeth (not shown) of the corresponding city gear 170*a*-170*e*). The second display ring gear 172 is similarly connected to or meshes with the second display ring 170. The time set post 136 is connected to the movement couplers 134 that are in turn connected (directly or indirectly) to the hand drive sub-assembly 132. For example, the time set post 136 can be articulated transversely (relative to a center point of the assembly), bringing the end 155 of the time set post shaft 152 into selective engagement with a corresponding one of the hour hand coupler 150*a*, the minute hand coupler 150*b*, or the second hand coupler 150*c*. The first-fourth year gears 160*a*-160*d* are connected to or meshed with respective ones of the first-fourth year rings 80*a*-80*d* such that rotation of the year gear 160*a*-160*d* would cause rotation of the corresponding year ring 80*a*-80*d*. The month gear 162 has a similar relationship with the month ring 82, as does the date gear 164 with the date ring 84, and the AM/PM gear 166 with the AM/PM ring 86. The date set post 138 is selectively connected to or meshed with each of the year gears 160*a*-160*d*, the month gear 162, the date gear 164 and the AM/PM gear 166. For example, the date set post 138 can be articulated transversely (relative to a center point of the assembly), bringing the end 159 of the date set post shaft 156 into selective engagement with a corresponding one of the year gears 160*a*-160*d*, the month gear 162, the date gear 164 and the AM/PM gear 166.

Figure 9B:
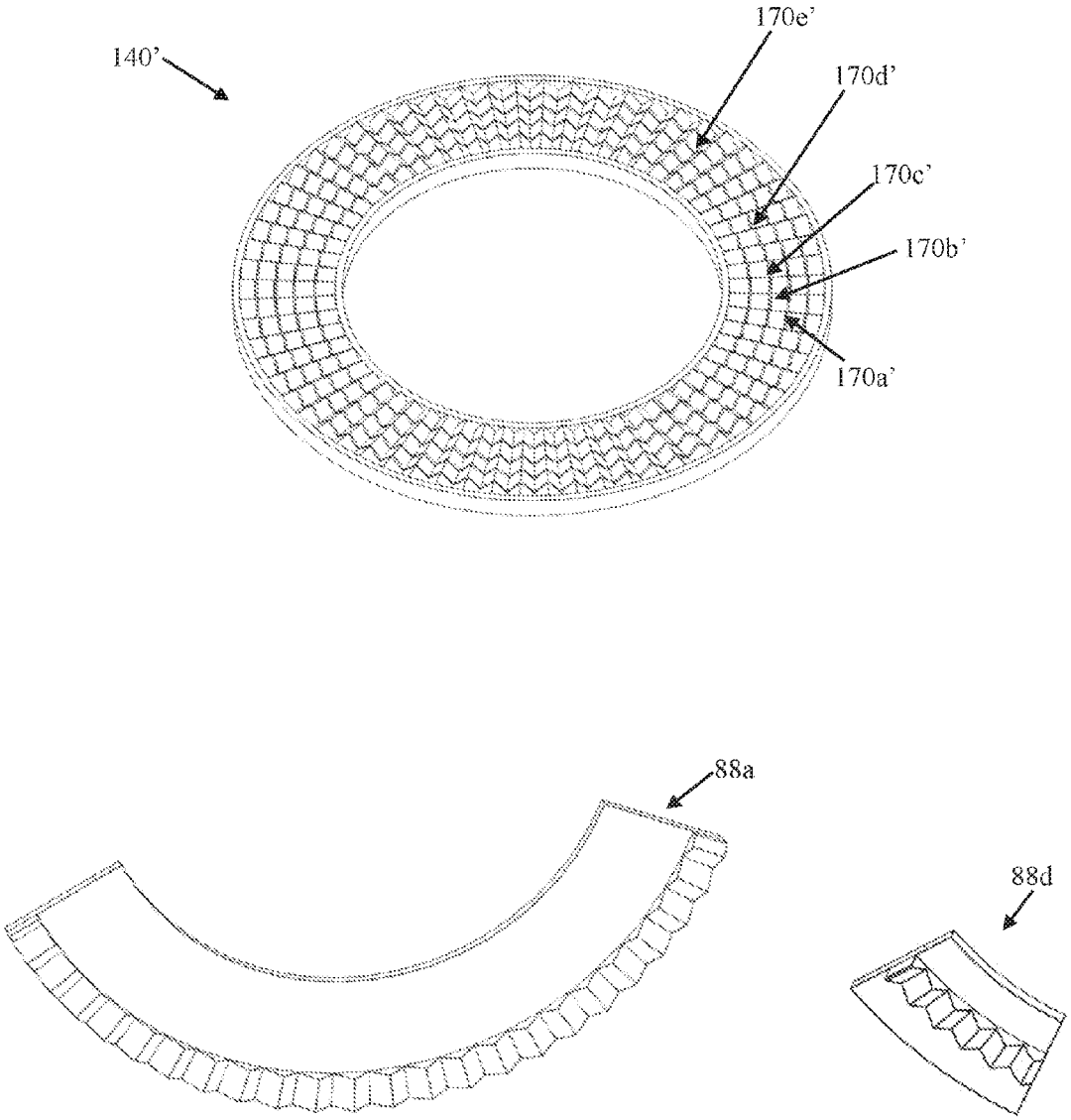
FIG. 9B is a simplified perspective view of an alternative gear arrangement useful with the control assembly of FIG. 8.

FIG. 9B illustrates, in simplified form, an alternative configuration of control gears 140', and in particular first-fifth city gears 170*a*'-170*e*'. The first-fifth city gears 170*a*'-170*e*' are concentrically arranged, each providing a toothed surface configured to mesh with teeth provided on a rear face of each the partial city rings 88*a*-88*e* (two of which are shown in enlarged form in FIG. 9B). The partial city rings 88*a*-88*e* and the first-fifth city gears 170*a*'-170*e*' are constructed and arranged such that each partial city ring 88*a*-88*e* interfaces with or is acted upon a corresponding, respective one of the first-fifth city gears 170*a*'-170*e*'.

Returning to FIG. 3, the bezel assembly 56 includes a bezel 180 and a spring 182. The bezel 180 is configured to maintain various components of the display assemblies 50, 52 and the control assembly 54 relative to one another, as well as to facilitate user interaction with at least the first display ring 70 as described below. In this regard, the spring 182 biases the bezel 180 to a disengaged position relative to the first display ring 70.

Figure 10A:
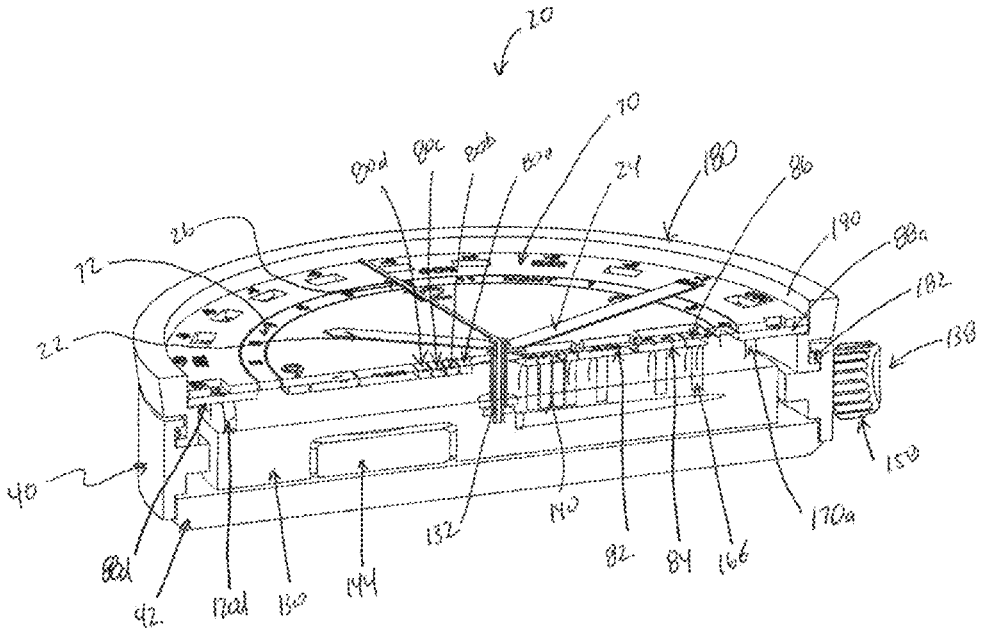
FIGS. 10A and 10B are perspective, cross-sectional views of the watch of FIG. 1A.
Figure 10B:
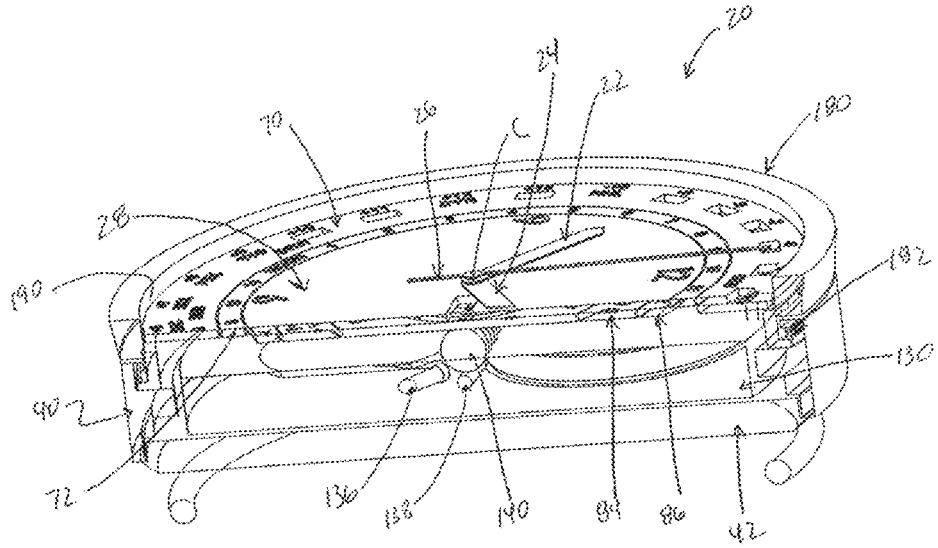

Final assembly of the watch 20 is shown in FIGS. 10A and 10B. For ease of explanation, the watch 20 is shown with the front cover 44 removed. The back cover 42 and the bezel 180 are coupled to opposite sides of the case 40, with the bezel spring 182 biasing the bezel 180 to the normal position shown. The movement sub-assembly 130 and the power supply 144 are supported against the back cover 42. The time set post 136 (hidden in FIG. 10A and shown partially in 10B) and the date set post 138 extend through the case 40 to the arrangement described above, with the corresponding crowns 154, 158 (the crown 154 of the time set post 136 being hidden in the views of FIGS. 10A and 10B) being located outside of the case 40 and available to be manipulated by a user. The first display ring 70 is supported within a rim 190 of the bezel 180. The second display ring 72 is supported concentrically within the first display ring 70 in a manner permitting the second display ring 72 to rotate relative to the first display ring 70 (and vice-versa), for example by the second display ring gear 172 (hidden in FIGS. 10A and 10B, but shown in FIG. 8). The primary display 28 is supported concentrically within the second display ring 72 (in a manner permitting the second display ring 172 to rotate relative to the primary display 28). The hands 22-26 are arranged over the primary display 28 and are coupled to the hand drive assembly 132 that in turn is connected to the movement sub-assembly 130. The first-fifth partial city rings 88*a*-88*e* underlie the first display ring 70, each circumferentially aligned with the first display ring 70 in a manner permitting the first-fifth partial city rings 88*a*-88*e* to move or rotate about the central axis C independent of the first display ring 70. For example, the first city gear 170*a* (that otherwise supports the first partial city ring 88*a*) and the fourth city gear 170*d* (that otherwise supports the fourth partial city ring 88*d*) are visible in the view of FIG. 10A. The AM/PM ring 86 underlies, and is rotatable relative to, the primary display 28, for example supported by the AM/PM gear 166. The date ring 84, the month ring 82, and the year rings 80*a*-80*d* similarly underlie, and are rotatable relative to, the primary display, for example supported by the corresponding one of the set gears 140 (referenced generally).

As mentioned above, the watch 20 includes the computer-type controller 146 (FIG. 8) programmed to perform various operations in accordance with principles of the present disclosure, including automated shifting or movement of components relative to one another in response to, for example, a user indicating a desired current time, date, locale or other setting to the watch 20 and/or determined occurrence of a daylight savings time event. Several of the optional operational programs automatically effectuated by the controller 146 in some embodiments are provided below, it being understood that the present disclosure is not limited to any one or more or all such operations.

Figure 11A:
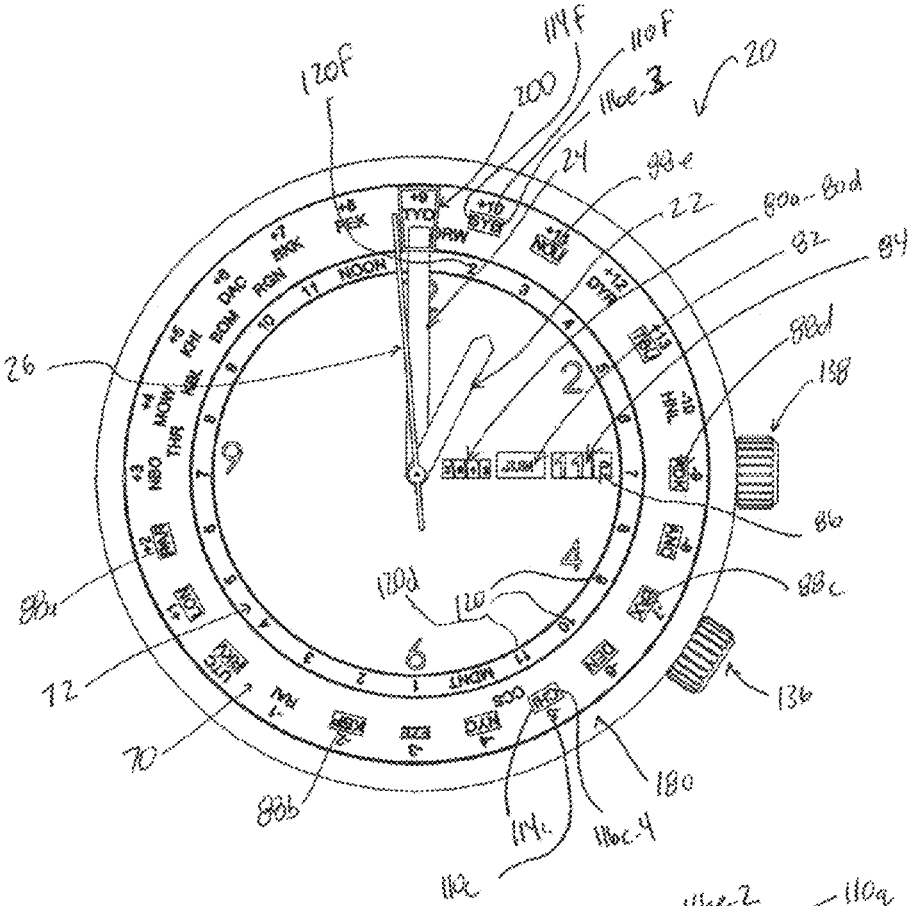
FIGS. 11A-15B are front views of the watch of FIG. 1A and illustrating various automated operations.

With initial reference to FIG. 11A, the watch 20 has been set to display a current time of 1:00 PM, a current date of Jun. 11, 2013, and a current locale of Tokyo (or any other locale that is in the same time zone as Tokyo). The current time (i.e., arrangement of the hour and minute hands 22, 24) and the current date are "entered" by a user via actuation of the time and/or date set posts 136, 138. The current locale is "entered" by a user via rotation of the first display ring 70 until the locale of interest is aligned with the twelve o'clock position. For example, the bezel 180 can be lifted by the user so as to engage the first display ring 70 and then rotated to bring the desired locale to the twelve o'clock position. In some embodiments, the watch 20 can include an optional selection indicator 200 that highlights to a user which city/locale has been selected as the current locale. The optional selection indicator 200, where provided, can be located at various positions, such as the twelve o'clock position as shown, the six o'clock position, etc. Regardless, information relating to the set current time, current date and current locale is identified and acted upon by the controller 146 (FIG. 8), with the controller 146 in turn operating to arrange the second display ring 72 and the partial city rings 88*a*-88*e* in an appropriate fashion. For example, in the view of FIG. 11A, the second display ring 72 has been rotated to align the "1" (PM) hour indicia 120*d* (hidden behind the minute hand 24 in FIG. 11A) with the 12 o'clock position. Further, the controller 146 is programmed with daylight savings time protocols throughout the world, and locates the partial city rings 88*a*-88*e* relative to the first display ring 70 based upon reference to the set current date so that correct information is displayed by the watch 20.

Although all the cities/locales implicated by the partial city rings 88*a*-88*e* practice daylight savings time, on Jun. 11, 2013, daylight savings time is in effect for some of the cities/locales and is not in effect in others. For example, daylight savings time is in effect in Chicago and as such, Chicago is five hours "behind" UTC; the controller 146 has thus prompted movement of the third partial city ring 88*c* relative to the first display ring 70 such that the first "CHI" city indicia 116*c*-4 is aligned with and visible through the third aperture 114*c* associated with the "−5" UTC off-set indicia 110*c*. Further, an "11" (PM) hour indicia 120*e* of the second display ring 72 is aligned with the visible "CHI" city indicia 116*c*-4, informing the viewer that it is currently 11:00 PM in Chicago. By way of further example, daylight savings time is not in effect in Sydney on Jun. 11, 2013 and as such, Sydney is 10 hours "ahead" of UTC; the controller 146 has thus prompted movement of the fifth partial city ring 88*e* relative to the first display ring 70 such that a second "SYD" city indicia 116*e*-3 is aligned with and visible through a sixth aperture 114*f* that is otherwise aligned with a "+10" UTC off-set indicia 110*f* (and with the "2" (PM) hour indicia 120*f* of the second display ring 72).

Figure 11B:
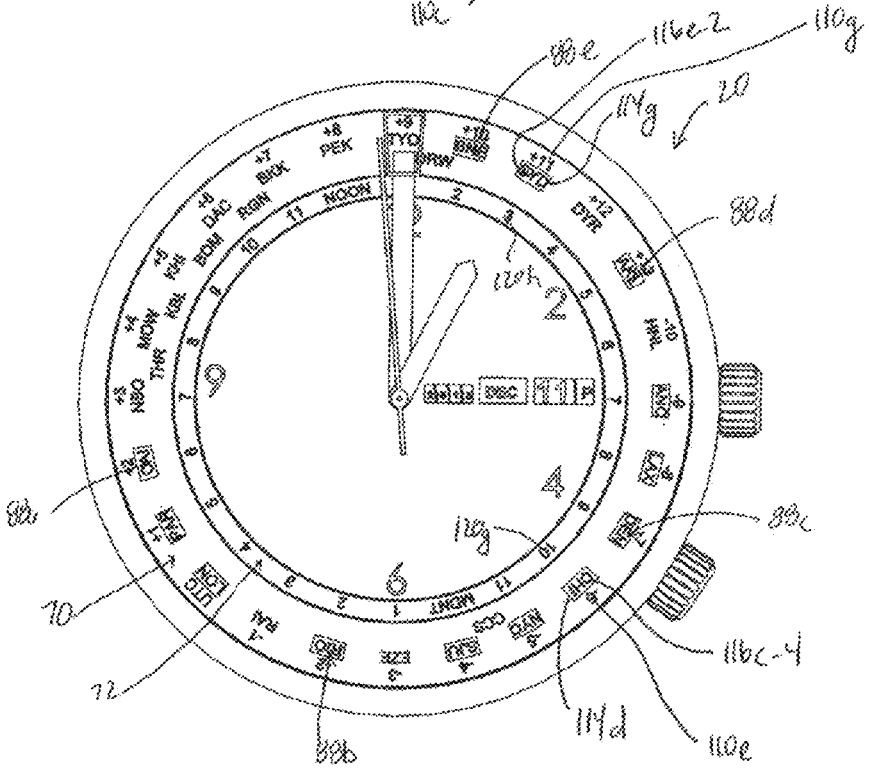

The watch 20 operates in a conventional manner, with the hands 22-26 and the AM/PM ring 86 moving to accurately display the current time of the selected city; the displayed current date information similarly changes in a conventional manner, with the day ring 84, the month ring 82 and the year rings 80*a*-80*d* being prompted to automatically, either by standard watch mechanisms or as dictated by the controller 146. The controller 146 tracks the current date and is programmed to alter some or all of the partial city rings 88*a*-88*e* relative to the first display ring 70 (and/or vice-versa) when the current date implicates a change in daylight savings time in one or more locales associated with the partial city rings 88*a*-88*e*. For example, FIG. 11B is a view of the watch 20 of FIG. 11A displaying a current time of 1:00 PM but at a later date in time. The user has not "entered" any new settings into the watch 20 between the views of FIGS. 11A and 11B (e.g., the current locale setting of Tokyo has not changed); instead, the displayed current date has progressed to Dec. 11, 2013.

Comparing FIG. 11B (Dec. 11, 2013) with FIG. 11A (Jun. 11, 2013), it will be recalled that Tokyo does not practice daylight savings time; thus, the difference in dates (Jun. 11, 2013 of FIG. 11A vs. Dec. 11, 2013 of FIG. 11B) does not cause the controller 146 to move or rotate the first display ring 70 or the second display ring 72. However, the controller 146 has automatically prompted the partial city rings 88*a*-88*e* to move pursuant to a programmed protocol. For example, on Dec. 11, 2013, daylight savings time is not in effect in Chicago and as such, Chicago is now six hours "behind" UTC; the controller 146 has thus prompted automatic movement of the third partial city ring 88*c* relative to the first display ring 70 such that the "CHI" city indicia 116*c*-5 is aligned with and visible through the fourth aperture 114*d*, otherwise aligned with the "−6" UTC off-set indicia 110*e*, and with a "10" (PM) hour indicia 120*g* of the second display ring 72. Thus, the user is correctly informed that it is currently 10:00 PM in Chicago. By way of further example, daylight savings time is in effect in Sydney on Dec. 11, 2013 and as such, Sydney is now 11 hours "ahead" of UTC; the controller 146 has thus prompted movement of the fifth partial city ring 88*e* relative to the first display ring 70 such that the "SYD" city indicia 116*e*-2 is aligned with and visible through the aperture 114*g* associated with the "+11" UTC off-set indicia 110*g* (and with a "3" (PM) hour indicia 120*h* of the second display ring 72). Thus, the user is correctly informed that it is currently 3:00 PM in Sydney.

Figure 12:
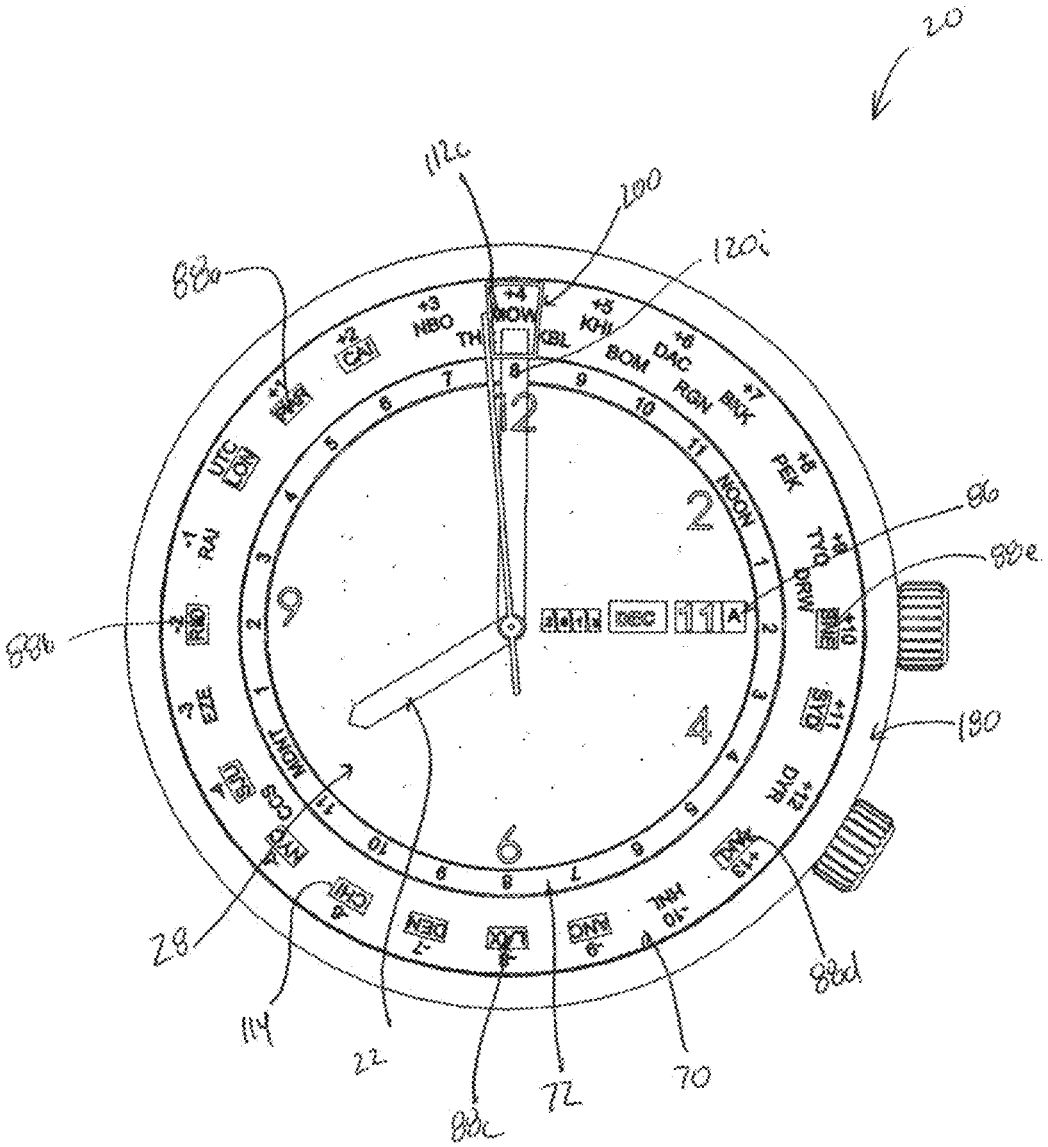

Another example of an operation automatically performed by the watch 20 in accordance with principles of the present disclosure includes automatically changing the displayed time upon a user entering a new locale setting. For example, the watch 20 in FIG. 11B has been set such that a current displayed setting is 1:00 PM Tokyo on Dec. 11, 2013. FIG. 12 illustrates the watch 20 of FIG. 11B, immediately after the first display ring 70 has been rotated by a user (e.g., via the bezel 180) to bring the "MOW" city indicia 112*c* within the selection indicator 200 (i.e., the first display ring 70 has been rotated to locate the "MOW" city indicia 112*c* at the twelve o'clock position). "MOW" is readily understood to be an abbreviation for the city of Moscow, Russia. This hypothetical scenario might occur, for example, were the user to have traveled from Tokyo to Moscow on Dec. 11, 2013, and upon arriving, simply rotated the first display ring 70 to locate "MOW" in the selection indicator 200. This rotation may or may not require lifting the bezel 180 and holding the bezel 180 in the lifted position during rotation. Alternatively, this rotation could be accomplished by rotation of an additional crown intended for that purpose. Once the new locale has been "entered" by the user, the controller 146 automatically recognizes the change the time zone setting. Comparing FIG. 12 to FIG. 11B, then, the controller 146 has automatically prompted the hour hand 22 to rotate to a position indicative of 8:00, and the AM/PM ring 86 to display "A" at the primary display 28. Thus, the display of the watch 20 has been automatically changed to correctly indicate that the current time (in the Moscow time zone) is 8:00 AM (and as a point of confirmation, in the view of FIG. 11B (i.e., just prior to user-initiated movement of the first display ring 70), an "8" (AM) hour indicia 120*i* provided with the second display ring 72 is aligned with the "MOW" city indicia 112*c*). The controller 146 has also automatically prompted the second display ring 72 to rotate in a corresponding fashion, aligning the "8" (AM) hour indicia 120*i* with the "MOW" city indicia 112*c* at the twelve o'clock position. Finally, the controller 150 has prompted the partial city rings 88*a*-88*e* to move in accordance with the sensed movement of the first display ring 70, maintaining the same city indicia-to-aperture 114/UTC off-set indicia 110 relationships (e.g., the designation in FIG. 11B that Chicago has a UTC off-set of "−6" is duplicated in FIG. 12). Alternatively, all of the partial city rings 88*a*-88*e* can be coupled mechanically to the first display ring 70 such that they all move in concert when the user moves "MOW" to the selected city position.

Figure 13:
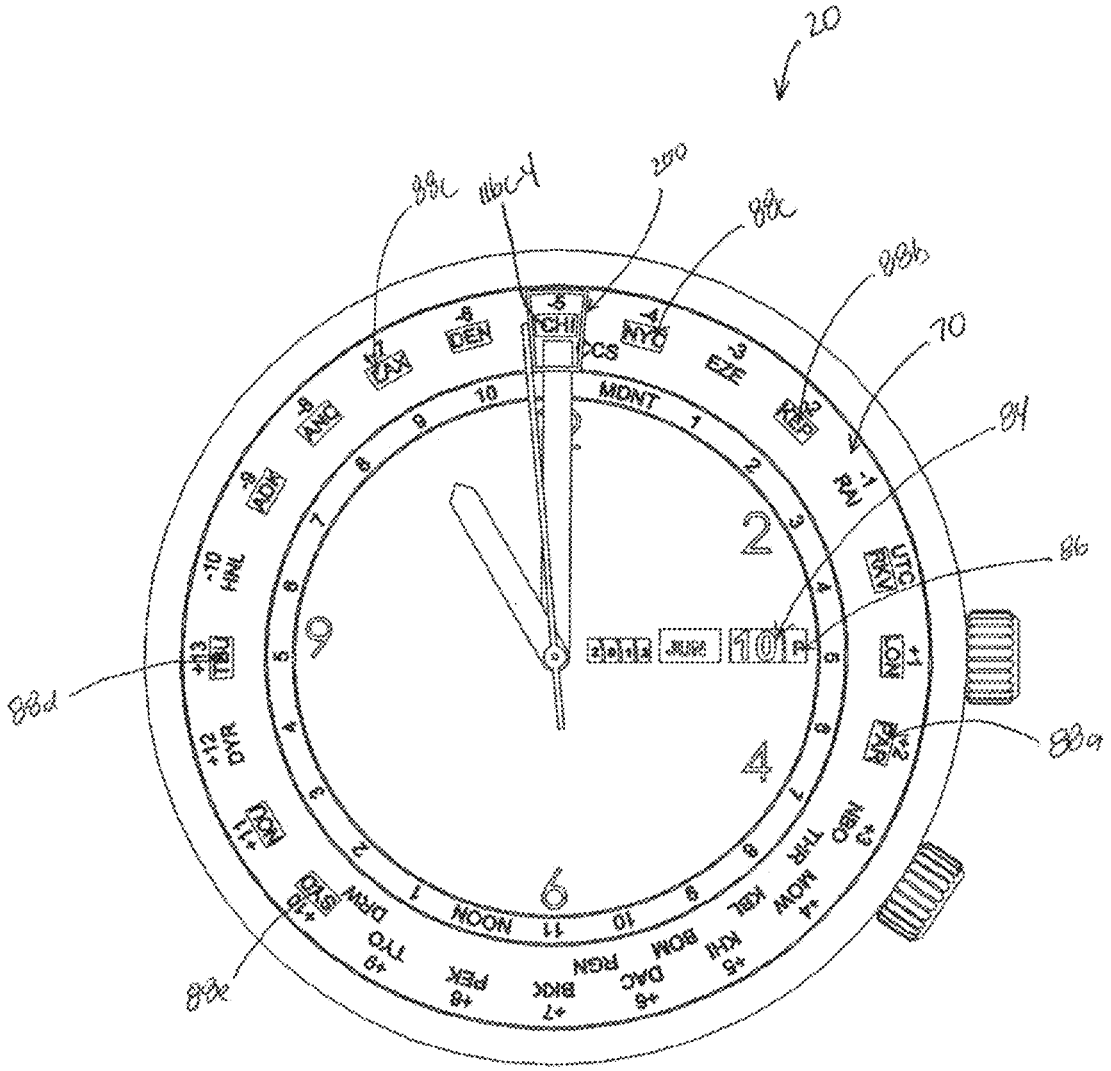

With the hypothetical of the previous paragraph, the "new" current locale being entered or set to the watch 20 (i.e., Moscow) was carried or permanently displayed on the first display ring 70. In other examples, the controller is programmed to perform similar, automated operations under circumstances where new current locale being entered by the user is provided on one of the partial city rings 88*a*-88*e* that underlie the first display ring 70. Further, the controller can be programmed to effectuate a change in the displayed date under circumstances where the entered change in locale implicates a change in date. For example, the watch 20 as set as in FIG. 11A displays a current time of 1:00 PM in Tokyo (or other locale in the same time zone as Tokyo) on Jun. 11, 2013. FIG. 13 illustrates the watch 20 of FIG. 11A immediately after user-prompted rotation of the first display ring 70. In particular, the first display ring 70 has been rotated to bring the "CHI" city indicia 116*c*-4 (otherwise carried by the third partial city ring 88*c*) within the selection indicator 200. In this regard, the partial city rings 88*a*-88*e* can be linked to the first display ring 70 such that when the first display ring 70 is lifted and rotated, the partial city rings 88*a*-88*e* move in tandem with the first display ring 70 and the bezel 180. Alternatively, the controller 146 can be programmed to automatically prompt movement of the partial city rings 88*a*-88*e* in tandem with the first display ring 70. Regardless, the "CHI" city indicia 116*c*-4 is entered as the current locale in the arrangement of FIG. 13. As a point of reference, on Jun. 11, 2013, Chicago is fourteen hours "behind" Tokyo; thus 1:00 PM on Jun. 11, 2013 in Tokyo corresponds with 11:00 PM on Jun. 10, 2013 in Chicago. The controller is programmed with this information, and upon recognizing that Chicago has been entered as the set locale, automatically prompts movement of the hour hand 22 to indicate 11:00, movement of the AM/PM ring 86 to display "P", and movement of the date ring 84 to display "10".

Figure 14A:
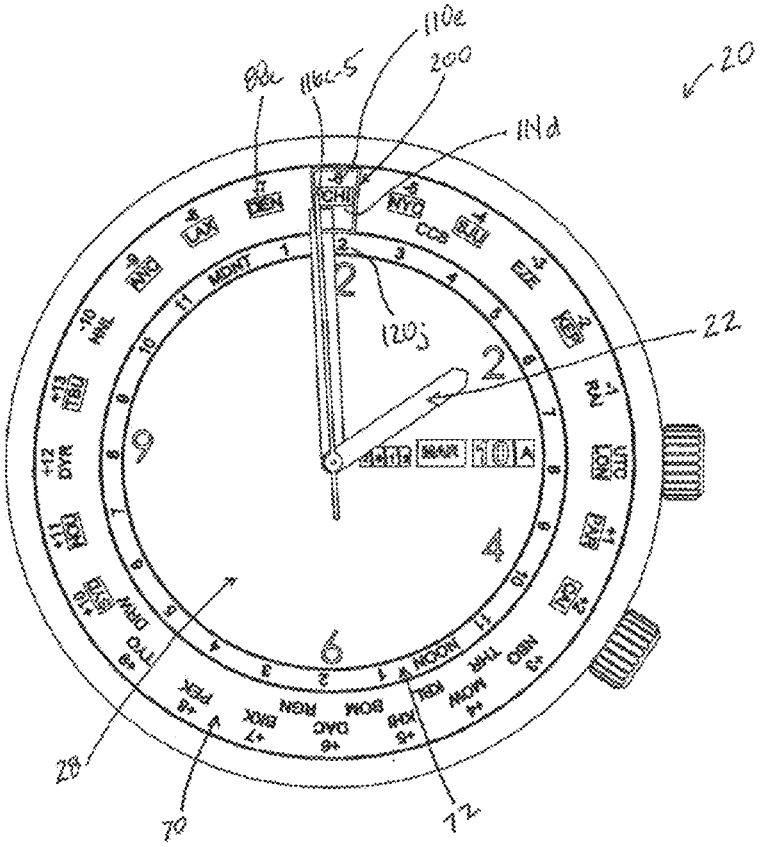

Another operation programmed to and automatically performed by the watch 20 in some embodiments relates to automated adjustment of the displayed information upon occurrence of a daylight savings time event, and in particular the start of daylight savings time, in the city/locale to which the watch 20 has been set. For example, FIG. 14A shows the watch 20 displaying a current time of 1:59:59 AM (i.e., the hour hand 22 is approximately aligned with the 2 o'clock position of the primary display 28) on Mar. 10, 2013 for the set or selected city of Chicago. As highlighted within the selection indicator 200, at this exact moment in time, the third partial city ring 88*c* is arranged relative to the first display ring 70 such that the second "CHI" city indicia 116*c*-5 is aligned with, and visible through, the aperture 114*d* that is otherwise aligned with the "−6" UTC off-set indicia 110*e*. Thus, at the point in time of FIG. 14A, a viewer understands that Chicago is six hours "behind" UTC. Further, the second display ring 72 is arranged relative to the first display ring 70 such that the "2" (AM) hour indicia 120*j* is aligned with the aperture 114*d* (and thus the displayed "CHI" city indicia 116*c*-5).

Figure 14B:
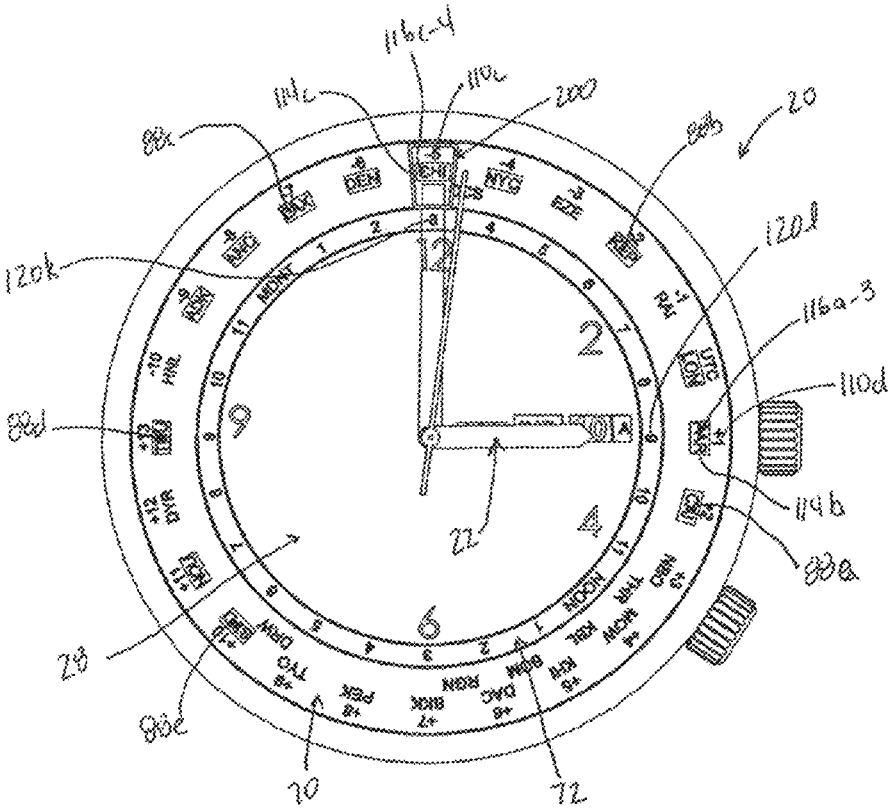

The daylight savings time protocols followed by Chicago dictate that at 2:00:00 AM on Mar. 10, 2013, a one hour forward time shift occurs. FIG. 14B illustrates the watch 20 of FIG. 14A three seconds later in time, and highlights automated operation in response to this daylight savings time event. The controller 146 provided with the watch 20 is programmed to recognize the occurrence of the daylight savings time event and effectuate various watch component movements immediately following the event. Comparing FIG. 14B with FIG. 14A, the controller 146 has prompted the hour hand 22 to rotate relative to the primary display 28, and is now approximately aligned with the 3 o'clock position of the primary display 28. Further, the first display ring 70 has been prompted to rotate relative to the primary display 28, aligning the "−5" UTC off-set indicia 110*c*, and the corresponding aperture 114*c*, within the selection indicator 200. The third partial city ring 88*c* has been prompted to rotate relative to the first display ring 70, aligning the first "CHI" city indicia 116*c*-4 with the aperture 114*c*. The remaining partial city rings 88*a*, 88*b*, 88*d*, 88*e* have been prompted to rotate in tandem with the first display ring 70. Finally, the second display ring 72 has been prompted to rotate relative to the primary display 28, arranging a "3" (AM) hour indicia 120*k* at the 12 o'clock position (i.e., aligned with the selection indicator 200).

As evidenced by the above explanations, the user is not required to make any manual adjustments to the watch 20 in response to the described daylight savings time event. The watch 20 automatically and correctly transitions to the display of FIG. 14B whereby the current time is correctly displayed as 3:00:02 AM on Mar. 10, 2013 for the selected or set city of Chicago. The "−5" UTC off-set indicia 110*c* is aligned with the displayed "CHI" city indicia 116*c*-4, and accurately reflects that Chicago is now five hours "behind" UTC. The "3" (AM) hour indicia 120*k* is correctly aligned with the displayed "CHI" city indicia 116*c*-4. Notably, the watch 20 is programmed to correctly account for the fact that while a one hour forward time shift has been effectuated in Chicago (at 2:00 AM on Mar. 10, 2013), most other locales around the world do not experience that same one hour forward time shift at the same time. By prompting the partial city rings 88*a*, 88*b*, 88*d*, 88*e* (i.e., the partial city rings apart from the third partial city ring 88*c* that otherwise carries the "CHI" city indicia) to move in tandem with the first display ring 70, the display of both FIGS. 14A and 14B correctly reflect that Paris (e.g., the "PAR" city indicia) remains one hour "ahead" of UTC (via alignment of the "PAR" city indicia 116*a*-3 with the aperture 114*b* corresponding the with the "+1" UTC off-sent indicia 110*d*) and that it is currently 9:00 AM in Paris (via alignment of the "9" AM hour indicia 120*d* carried by the second display ring 72 with the visible "PAR" city indicia 116*a*-3).

Figure 15A:
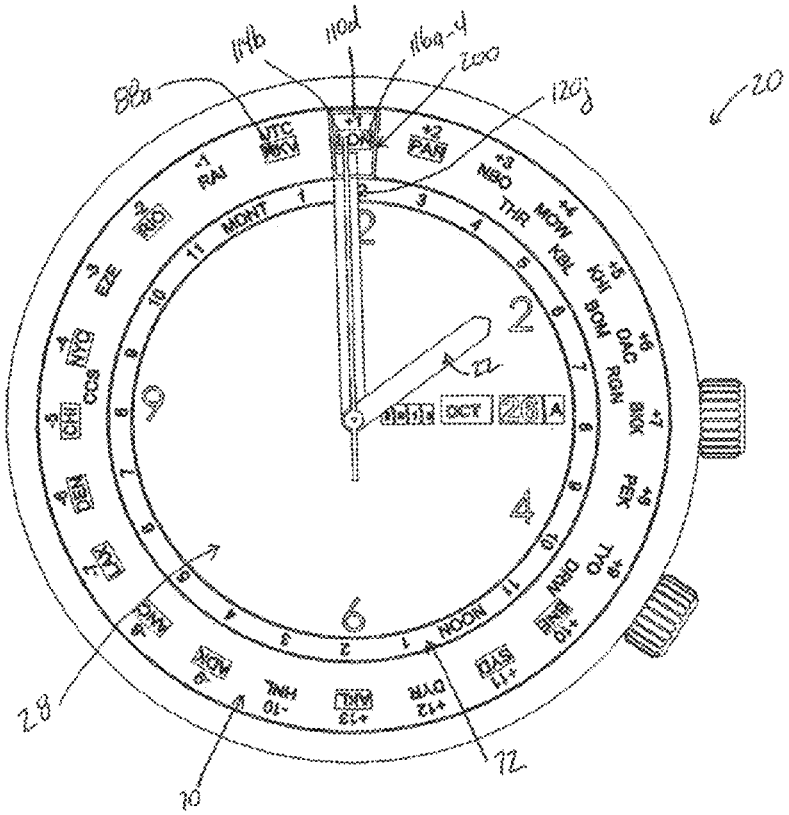

Another operation programmed to and automatically performed by the watch 20 in some embodiments relates to automated adjustment of the displayed information upon occurrence of a daylight savings time event, and in particular the end of daylight savings time, in the city/locale to which the watch 20 has been set. For example, FIG. 15A shows the watch 20 displaying a current time of 1:59:59 AM (i.e., the hour hand 22 is approximately aligned with the 2 o'clock position of the primary display 28) on Oct. 26, 2013 for the set or selected city of London. As highlighted within the selection indicator 200, at this exact moment in time, the first partial city ring 88*a* is arranged relative to the first display ring 70 such that the first "LON" city indicia 116*a*-4 is aligned with, and visible through, the aperture 114*b* that is otherwise aligned with the "+1" UTC off-set indicia 110*d*. Thus, at the point in time of FIG. 15A, a viewer understands that London is one hour "ahead" of UTC. Further, the second display ring 72 is arranged relative to the first display ring 70 such that the "2" (AM) hour indicia 120*j* is aligned with the aperture 114*b* (and thus the displayed "LON" city indicia 116*a*-4).

Figure 15B:
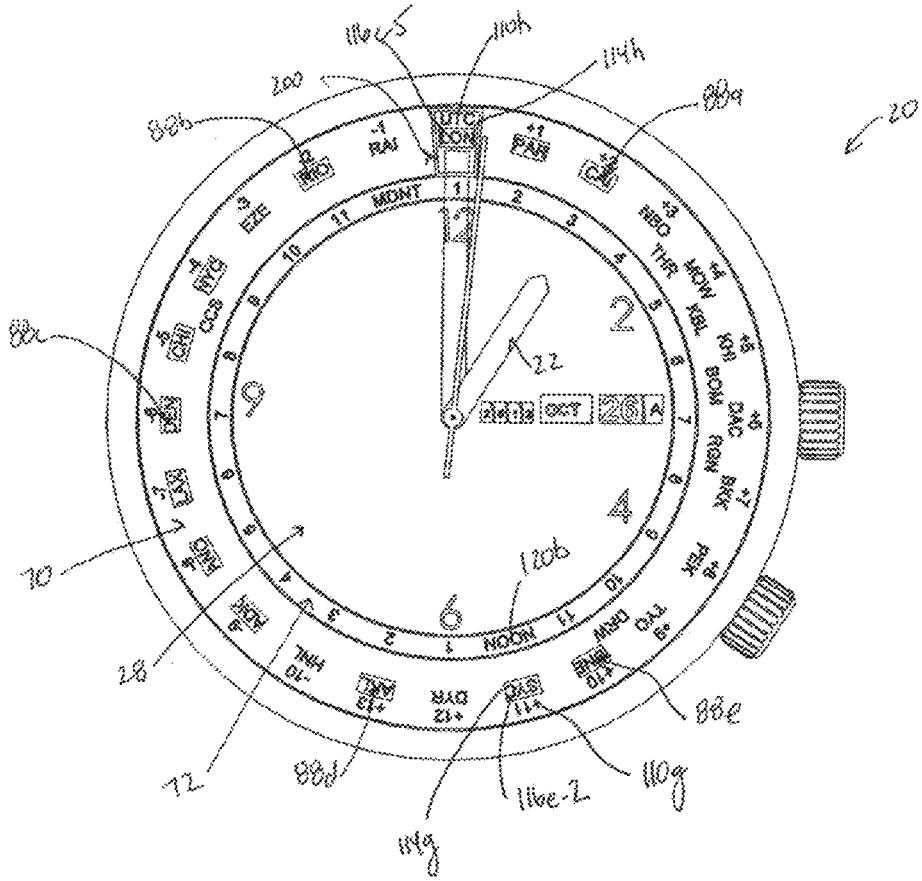

The daylight savings time protocols followed by London dictate that at 1:00:00 AM UTC (i.e., 2:00:00 AM London) on Oct. 26, 2013, a one hour backward time shift occurs. FIG. 15B illustrates the watch 20 of FIG. 15A three seconds later in time, and highlights automated operation in response to this daylight savings time event. The controller provided with the watch 20 is programmed to recognize the occurrence of the daylight savings time event and effectuate various watch component movements immediately following the event. Comparing FIG. 15B with FIG. 15A, the controller has prompted the hour hand 22 to rotate relative to the primary display 28, and is now approximately aligned with the 1 o'clock position of the primary display 28. Further, the first display ring 70 has been prompted to rotate relative to the primary display 28, aligning the "UTC" UTC off-set indicia 110*h*, and the corresponding aperture 114*h*, within the selection indicator 200. The first partial city ring 88*a* has been prompted to rotate relative to the first display ring 70, aligning the second "LON" city indicia 116*c*-5 with the aperture 114*h*. The remaining partial city rings 88*b*-88*e* have been prompted to rotate in tandem with the first display ring 70. Finally, the second display ring 72 has been prompted to rotate relative to the primary display 28, arranging the "1" (AM) hour indicia 120*c* at the 12 o'clock position (i.e., aligned with the selection indicator 200).

As evidenced by the above explanations, the user is not required to make any manual adjustments to the watch 20 in response to the described daylight savings time event. The watch 20 automatically and correctly transitions to the display of FIG. 15B whereby the current time is correctly displayed as 1:00:02 AM on Oct. 26, 2013 for the selected or set city of London. The "UTC" UTC off-set indicia 110*h* is aligned with the displayed "LON" city indicia 116*a*-5, and accurately reflects that London is now at UTC. The "1" (AM) hour indicia 120*c* is correctly aligned with the displayed "LON" city indicia 116*a*-5. Notably, the watch 20 is programmed to correctly account for the fact that while a one hour backward time shift has been effectuated in London (at 2:00 AM on Oct. 26, 2013), many other locales around the world do not experience a one hour backward time shift at the same time. By prompting the partial city rings 88*b*-88*e* (i.e., the partial city rings apart from the first partial city ring 88*a* that otherwise carries the "LON" city indicia) to move in tandem with the first display ring 70, the display of both FIGS. 15A and 15B correctly reflects, for example, that Sydney (e.g., the "SYD" city indicia 116*e*-2) remains eleven hours "ahead" of UTC (via alignment of the "SYD" city indicia 116*e*-2 with the aperture 114*g* corresponding the with the "+11" UTC off-sent indicia 110*g*) and that it is currently 12:00 noon in Sydney (via alignment of the "NOON" hour indicia 120*b* carried by the second display ring 72 with the visible "SYD" city indicia 116*e*-2).

Figure 16A:
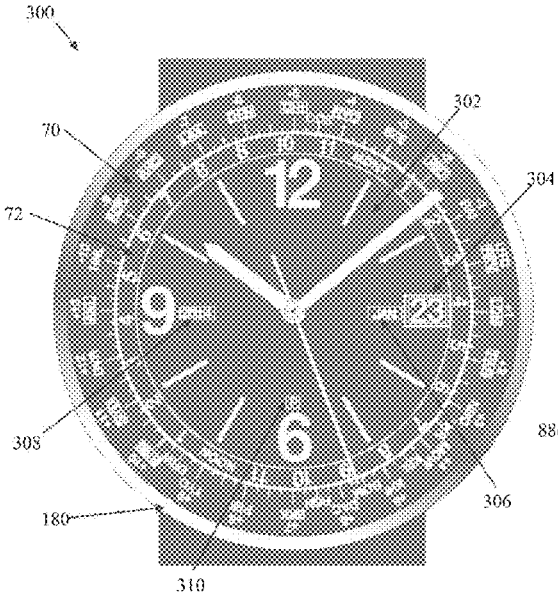
FIG. 16A is a front view of another world watch in accordance with principles of the present disclosure.

The world watches of the present disclosure can be programmed to perform multiple other operations via prompted manipulation of the various hands, rings and partial rings to automatically effectuate a change in the displayed current time, displayed current date, displayed UTC off-set relative to cities/locales of interest, and/or displayed hour indicia relative to cities/locales of interest. Further, while the watch 20 has been described as employing a series of concentrically arranged rings or partial rings, in other embodiments, a less-than fully concentric configuration is provided. For example, FIG. 16A is a front view of another embodiment watch 300 in accordance with principles of the present disclosure. The watch 300 is akin to the watch 20 described above, and generally includes a controller apparatus (not shown) configured (e.g., programmed) to automatically effectuate changes in information displayed at a face of the watch 300 in response to various events (e.g., a daylights saving time event, user-prompted change in set time, date or selected time zone city). The watch 300 further includes the hour, minute and second hands 22-26, the bezel 180, the first display ring 70, the second display ring 72, and the partial city rings 88*a*-88*d* as described above. A circular-shaped primary display 302 is also provided, with the hands 22-26 moving relative to the hour indicia on the primary display 302 to convey current time information (e.g., in the view of FIG. 16A, the hands are indicating a current time of approximately 10:10). Apertures 304-310 are formed through the primary display 302 and through which year, month, day, and AM/PM information is displayed.

Figure 16B:
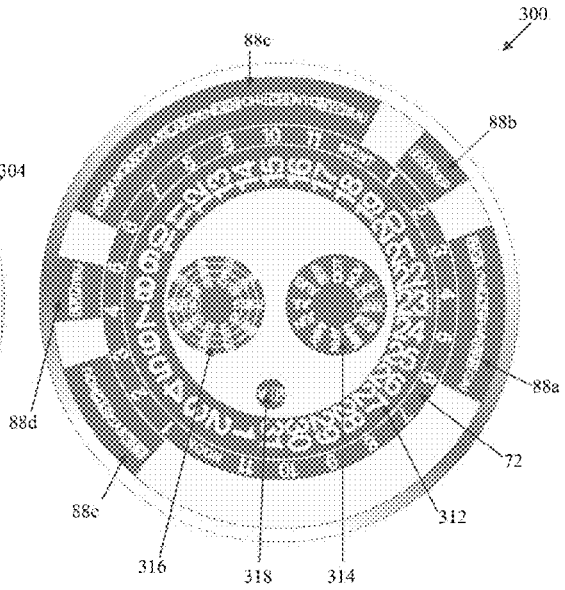
FIG. 16B is a front view of the watch of FIG. 16A with portions removed.

FIG. 16B provides a view of the watch 300 with the first display ring 70 and the primary display 302 removed, and reveals that the watch 300 further includes the partial city rings 88*a*-88*e* as described above. Further, the watch 300 includes a day ring 312, a month ring 314, year rings 316 (collectively identified), and an AM/PM ring 318. As compared to previous embodiments, and with cross-reference between FIGS. 16A and 16B, while the day ring 312 is concentrically arranged relative to the first and second display rings 70, 72, the month, year and AM/PM rings 314-318 are not. Instead, a tangential relationship is established. Each of the month, year and AM/PM rings 314-318 rotate about a corresponding center point that is off-set from a center point of the first and second display rings 70, 72. For example, the month ring 314 is configured such that upon final assembly, individual months (or abbreviations indicative of each month of the year) are selectively displayed through the corresponding aperture 306 in the primary display 302. Similar relationships are established by the year and AM/PM rings 316, 318 relative to the apertures 308, 310.

Figure 17A:
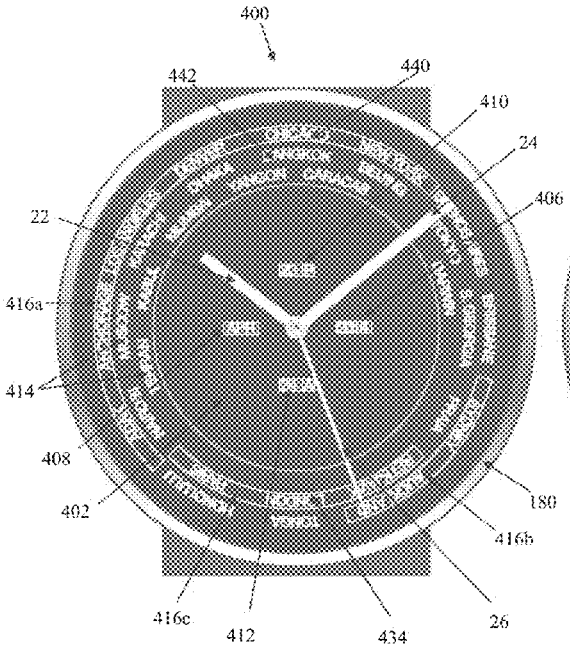
FIG. 17A is a front view of another world watch in accordance with principles of the present disclosure.
Figure 17B:
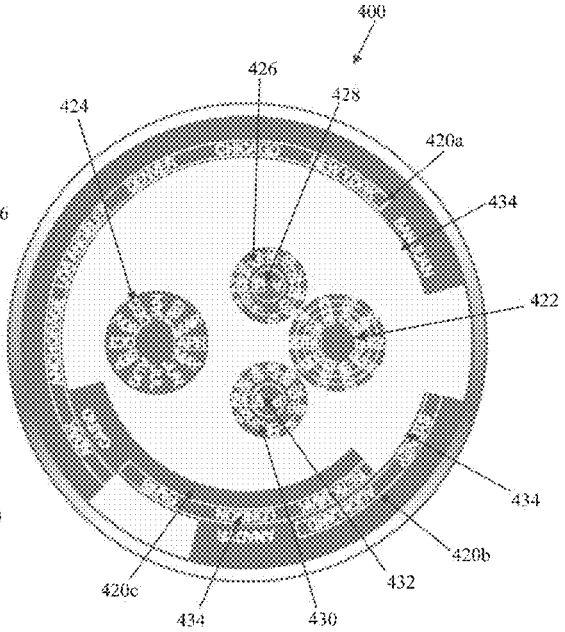
FIG. 17B is a front view of the watch of FIG. 17A with portions removed.

Another embodiment of a world watch 400 in accordance with principles of the present disclosure is shown in FIGS. 17A and 17B (with the view of FIG. 17B illustrating the watch 400 with various front face display components removed). The watch 400 is akin to the watch 20 described above, and generally includes a controller apparatus (not shown) configured (e.g., programmed) to automatically effectuate changes in information displayed at a face of the watch 400 in response to various events (e.g., a daylights saving time event, user-prompted change in set time, date or selected time zone city). The watch 400 includes the hour, minute and second hands 22-26 and the bezel 180 as described above. In addition, the watch 400 includes a primary display 402 and a display ring 404. The primary display 402 may or may not include or display hour indicia, with the hands 22-26 moving relative to the primary display 402 to convey current time information (e.g., in the view of FIG. 17A, the hands 22, 24 are indicating a current time of approximately 10:10). The primary display 402 forms several openings or apertures through which indicia on components located below the primary display 402 are selectively visible. For example, and as described in greater detail below, the primary display 402 forms a year aperture 406, a month aperture 408, an upper date and AM/PM aperture 410, and a lower date and AM/PM aperture 412.

The display ring 404 is akin to the first display ring 70 described above, and is connected to the bezel 180 so as to be rotatable about the primary display 402. The display ring 404 includes or displays city indicia 414 (referenced generally). The cities implicated by the city indicia 414 of the display ring 404 represent locales that do not follow or observe daylight savings time. The display ring 404 further defines city apertures 416*a*-416*c* for reasons made clear below.

FIG. 17B provides a view of the watch 400 with the primary display 402 and the display ring 404 removed, although an outlined representation of the various apertures 406-412 and 416*a*-416*c* is provided. FIG. 17B reveals that the watch 400 further includes partial city rings 420*a*-420*c*, year rings 422 (collectively identified), a month ring 424, upper date rings 426 (collectively identified), an upper AM/PM ring 428, lower date rings 430 (collectively identified) and a lower AM/PM ring 432. With cross-reference between FIGS. 17A and 17B, the first-third partial city rings 420*a*-420*c* are circumferentially aligned with a respective one of the first-third city apertures 416*a*-416*c*. Thus, various ones of the city indicia 434 carried on or displayed by the partial city rings 420*a*-420*c* are selectively visible through a corresponding one of the city apertures 416*a*-416*c* depending upon a rotational position of the particular city ring 420*a*-420*c* relative to the display ring 404 (and thus relative to the city apertures 416*a*-416*c*). The partial city rings 420*a*-420*c* are linked (directly or indirectly, mechanically or electromechanically) to a user actuator, for example the bezel 180, so that a user can effectuate a change in a rotational position of one or all of the partial city rings 420*a*-420*c* relative to the display ring 404 (and thus a change in the displayed city indicia 434 relative to the corresponding city aperture 416*a*-416*c*). Further, the partial city rings 420*a*-420*c* can be linked (directly or indirectly, mechanically or electromechanically) to a controller (not shown) provided with the watch 400 and pre-programmed as described above; the controller can selectively effectuate changes in the rotational position of one or more of the partial city rings 420*a*-420*c* relative to the display ring 404 (and thus relative to the corresponding city aperture 416*a*-416*c*) in response to various user inputs and/or daylight savings time events across the globe.

In addition, the controller is programmed to "recognize", at least in part, a designated city as having been "selected" by a user, and to base various daylight savings time operations off of the selected city. Commensurate with previous embodiments, a user can designate or select a desired city by manipulating the display ring 404 and/or the partial city rings 420*a*-420*c* to align the particular city indicia 414 or 434 at the twelve o'clock position. As evidenced by the view of FIG. 17A, a relationship of the city indicia 414 (of the display ring 404) relative to the city apertures 416*a*-416*c* (and thus relative to the city indicia 434 of the partial city rings 420-420*c*) is such that in many instances, two cities can be aligned at the twelve o'clock position (i.e., one of the city indicia 414 of the display ring 404 and one of the city indicia 434 of partial city rings 420*a*-420*c*). For example, in FIG. 17A, the city indicia 434 of the first partial city ring 420*a* of "CHICAGO" is aligned with the twelve o'clock position, as is the city indicia 414 of the display ring 404 of "BANGKOK". Relative to the twelve o'clock position, then, the aligned cities can be referred to as an upper designated city 440 and a lower designated city 442. With the arrangement of FIG. 17A, the upper designated city 440 is "CHICAGO", and the lower designated city 442 is "BANGKOK". In other possible arrangements of the watch 400, the upper designated city 440 can be provided by the city indicia 414 of the display ring 404, and the lower designated city 442 provided by the city indicia 434 of one of the partial city rings 420*a*-420*c*.

Regardless, the upper and lower designated cities 440, 442 represent two cities that are currently twelve hours out of phase with one another. Notably, the user is not required to "select" or input both of the upper and lower designated cities 440, 442; instead, the user merely manipulates the watch 400 such that the city corresponding (from a time zone perspective) to the user's current locale (or the city the user otherwise desires to "select") is at the twelve o'clock position. The watch 400 will self-prompt the corresponding, twelve hours out-of-phase companion city to also be aligned with the twelve o'clock position. For example, with the arrangement of FIG. 17A, the user may have intended to select "CHICAGO" and thus manipulated the watch 400 such that "CHICAGO" was aligned with the twelve o'clock position (and thus serving as the upper designated city 440). Depending upon the current date and time (including AM/PM designation) supplied to the watch 400 (i.e., as currently displayed or as inputted by a user) as described below, the watch controller determines the corresponding, twelve hour out-of-phase city and prompts alignment of the so-determined city with the twelve o'clock position. For example, with the arrangement of FIG. 17A, on Apr. 23, 2014, Bangkok is twelve hours out-of-phase with Chicago; the watch controller has thus prompted an orientation of the display ring 404 to align "BANGKOK" with the twelve o'clock position (and thus serving as the lower designated city 440). It will be understood that at other periods of the calendar year, a different city will be twelve hours out-of-phase with Chicago (i.e., Dhaka, Bangladesh); the controller recognizes the appropriate twelve hours out-of-phase city and prompts its display at the twelve o'clock position. This same scenario would automatically occur had the user intended to select BANGKOK as the city of interest (i.e., after the user had manipulated the watch 400 to locate "BANGKOK" at the twelve o'clock position, the watch controller would automatically prompt the partial city rings 420*a*-420*c* such that "CHICAGO" was also displayed at the twelve o'clock position). The watch 400 can include other features that further highlight a "selected" city to a user as with previous embodiments. Further, the controller can be programmed such that certain user inputs or actuations serve to designate that a particular city has been selected. Regardless, the watch 400 can display information that allows a viewer to quickly discern time and/or date differences between the upper and lower designated cities 440, 442.

More particularly, the year rings 422 are aligned with the year aperture 406 and are operated as with previous embodiments. Similarly, the month ring 424 is aligned with the month aperture 408 and is operated as with previous embodiments. The upper date rings 426 and the upper AM/PM ring 428 are aligned with the upper date and AM/PM aperture 410. The upper date rings 426 and the upper AM/PM ring 428 are operated as described above, and provide date and AM/PM information for the upper designated city 440. For example, in the view of FIG. 17A, the upper date and AM/PM rings 426, 428 indicate that the current time and date in the upper designated city 440 of "CHICAGO" are 10:10 PM on Apr. 23, 2014. The lower date rings 430 and the lower AM/PM ring 432 are aligned with the lower date and AM/PM aperture 412. The lower date rings 430 and the secondary AM/PM ring 432 are operated as described above, and provide date and AM/PM information for the lower designated city 442. For example, in the view of FIG. 17A, the lower date and AM/PM rings 430, 432 indicate that the current time and date in the lower designated city 442 of Bangkok are 10:10 AM on Apr. 24, 2014. As with previous embodiments, the controller is programmed to control operation of the various rings 422-432 in accordance with preprogrammed information or algorithms.

It will be recognized that the watch 400 could be arranged such that a city or locale following a non-integer time zone off-set (relative to UTC) is aligned with the twelve o'clock position (e.g., Caracas, Tehran, etc.). Under these circumstances, the so-selected city will serve as the lower designated city 442. No counterpart, twelve hour out-of-phase companion city is available, such that only one city will be aligned with the twelve o'clock position. The information displayed at the lower date and AM/PM aperture 414 will correspond with the lower designated city 442. Because a corresponding upper designated city is not specifically available, the watch controller can either prompt the upper date and AM/PM rings 426, 428 to a "partially displayed" position (e.g., a date and/or AM/PM designation is only partially visible through the upper date and AM/PM aperture 410) or to a blank position in which no information is displayed at the upper date and AM/PM aperture 410. In other embodiments, the watch 400 can be configured to show or display indicia indicative of all thirty-seven time zones as described elsewhere in the present disclosure. In yet other embodiments, the year rings 422 can be omitted.

Figure 18B:
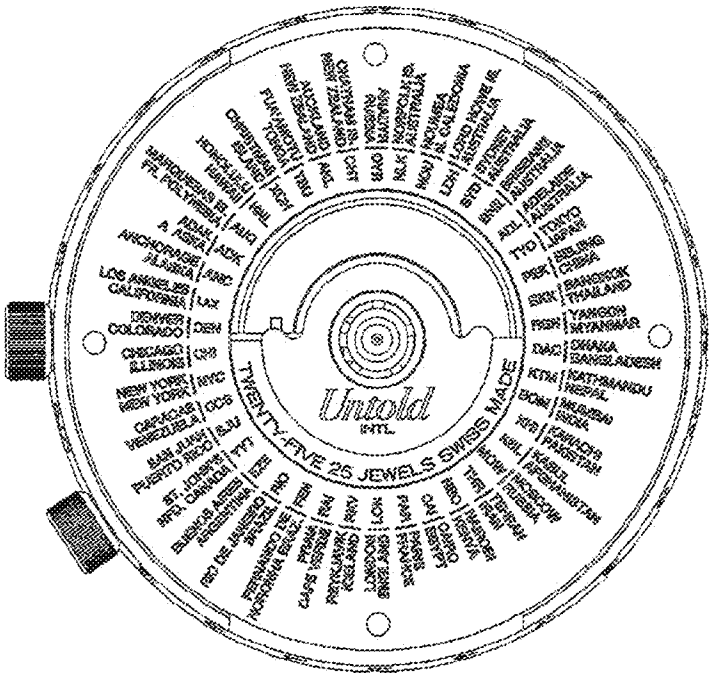
FIG. 18B is a rear view of the watch of FIG. 18A.
Figure 18A:
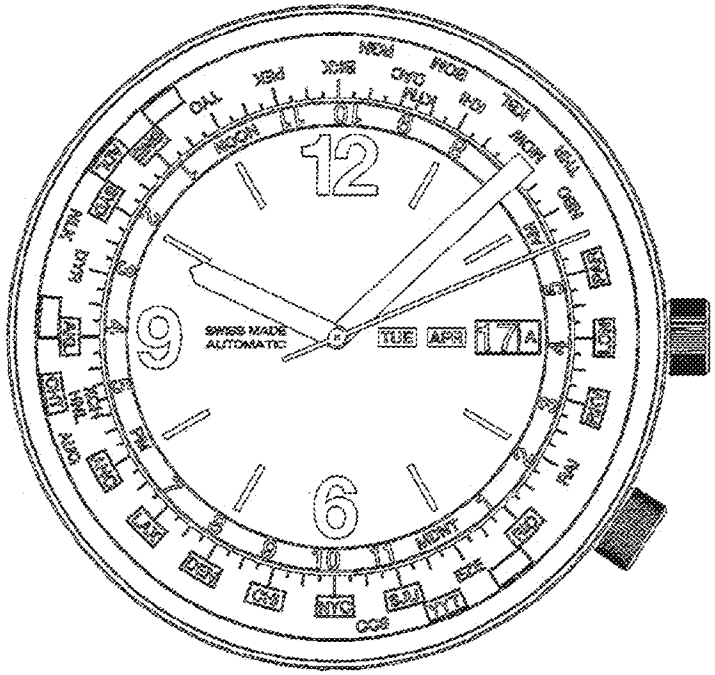
FIG. 18A is a front view of another world watch in accordance with principles of the present disclosure.
Figure 18C:
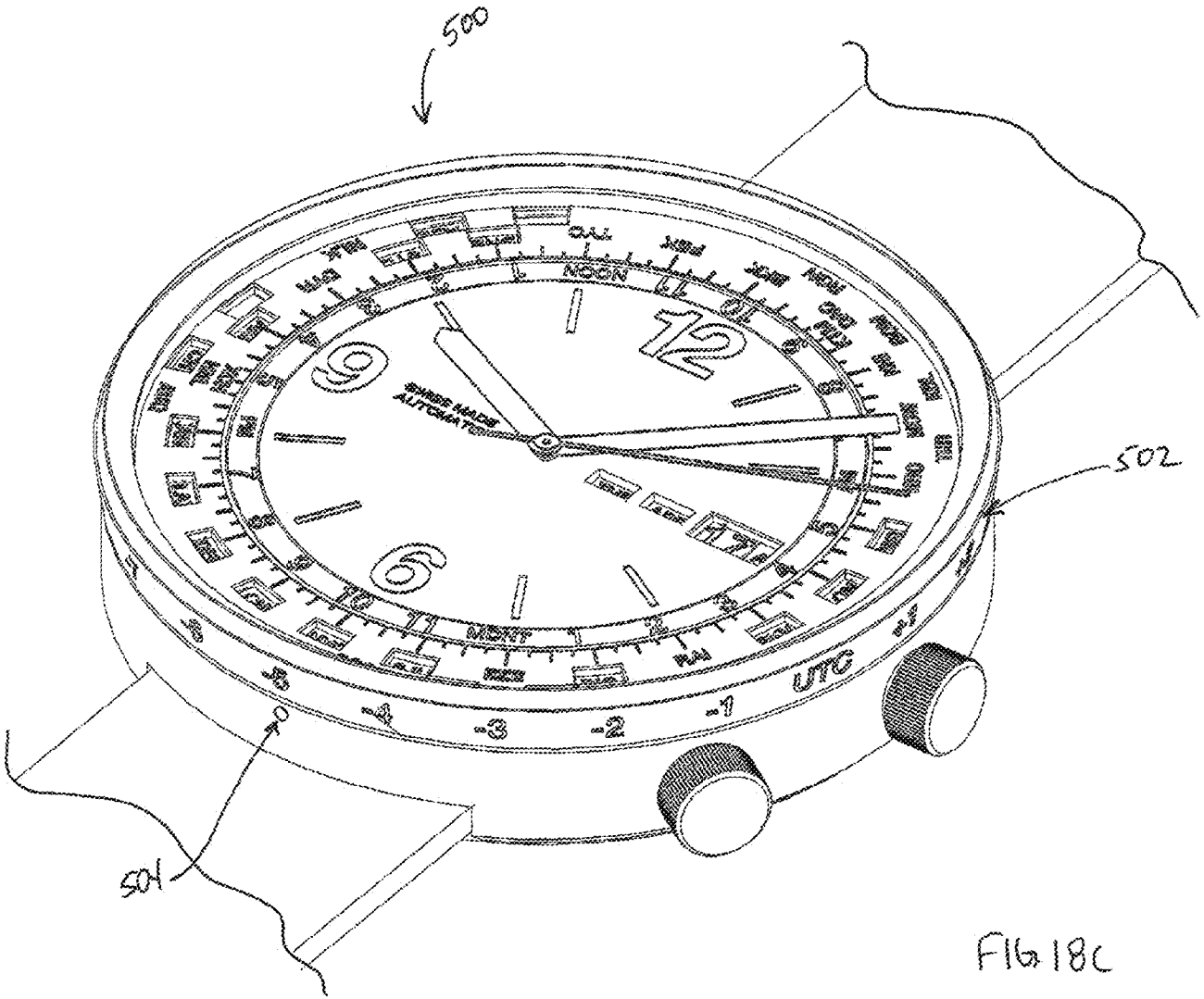
FIG. 18C is a side perspective view of the watch 18A and displaying current time and date information differing from that of FIG. 18A.

FIG. 18A is a front view of another embodiment watch 500 in accordance with principles of the present disclosure and that can be akin to the watch 20' shown in FIG. 1B. FIG. 18B is a rear view of the watch 500, and FIG. 18C is a side view. The watch 500 can be akin to previous embodiments, and includes various display features that provide a viewer with the ability to quickly ascertain the current date and time in a city of interest, as well as the current time in other cities across the globe. Further, the watch 500 self-corrects the displayed information for any daylight savings time event in any of the displayed locales. Optionally, the watch 500 is configured to automatically self-correct for daylight savings time events using with only mechanical components (i.e., in some embodiments, the watch 500 does not include a microprocessor or other electronic components). Mechanical only-based watch constructions are known to those of ordinary skill; in some embodiments, the watch 500 (as well as other watches of the present disclosure) tie into these known constructions to achieve new, fully mechanical functionality.

Figure 19:
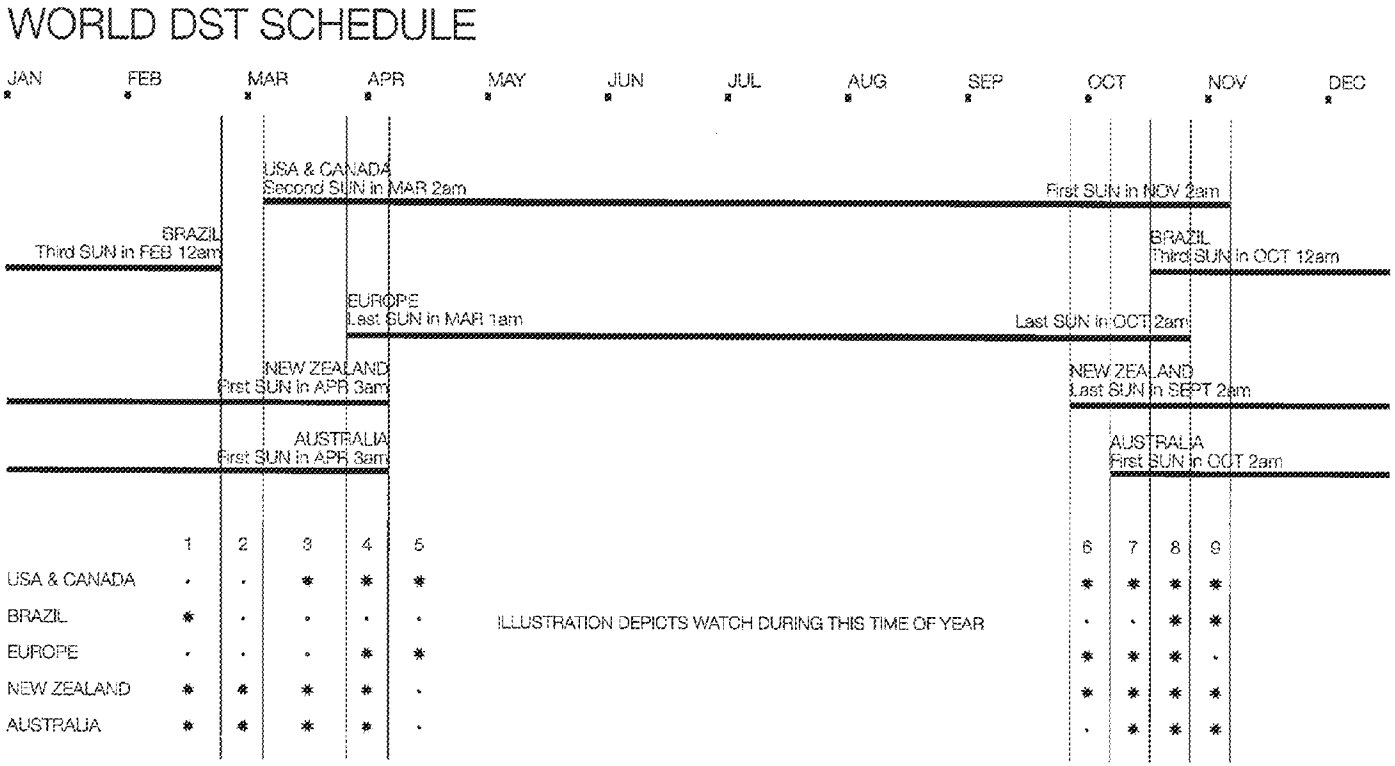
FIG. 19 is a chart providing global daylight savings time groupings world wide.

The mechanical automated daylight savings time automated self-correction features of the watch 500 are premised upon the recognition that every year, each region of the world programmatically begins and ends daylight savings time at the same time of day on the same Sunday of the same month. As a result, a mechanical movement can be incorporated into the watch 500 that counts the number of Sundays in each month, in each time zone, and at the correct Sunday at the correct time of year, triggers the one hour movement of the displayed cities within their respective daylight savings time zone. By overlaying this consistent logic across schedules of the five regions of the world that observe daylight savings time, nine distinct states of time across the world emerge. FIG. 19 is a chart illustrating the nine distinct states.

To enable functionality of the watch 500, the watch 500 optionally includes a mechanical accounting of: day of week, month, date, counting of Sundays, AM vs. PM, and exact time of day, across the world for the displayed cities (e.g., forty-two cities), representing each of the world's thirty-seven time zones, clustered into the five distinct world region daylight savings time schedules.

For example, Jan. 1, 2015 is a Thursday. At this time of year, cities that observe daylight savings time in North America and Europe are in Standard Time (ST). Cites that observe daylight savings time in South America, Australia and New Zealand are in Daylight Savings Time (DST). At the beginning of January (and the beginning of every month), the watch 500 counts the number of Sundays in that month. In 2015, February 1 is a Sunday. The watch 500 counts February 1 as the first Sunday of the month, and continues to count each Sunday. On the third Sunday of February (i.e., Feb. 15, 2015), the watch 500 automatically ends daylight savings time in Brazil, automatically setting the time in Rio De Janeiro, Brazil ("RIO") one hour back from UTC −2 to UTC −3. Fernando De Noronha, Brazil ("FEN"), also tracked by the watch 500 in one embodiment, is unaffected as FEN does not observe daylight savings time. The next state change on the watch 500 occurs on the second Sunday in March in the US and Canada. In 2015, that date is March 8, and at 2:00 AM the watch 500 automatically adjusts several North American cites to mark the beginning of DST in US and Canada. For example, Adak, Alaska ("ADK") changes from UTC −10 to UTC −9; Anchorage, Alaska ("ANC") changes from UTC −9 to UTC −8; Los Angeles, Calif. changes from UTC −8 to UTC −7; Denver, Colo. from UTC −7 to UTC −6; Chicago, Ill. from UTC −6 to UTC −5; New York, N.Y. from UTC −5 to UTC −4; St. John's, Newfoundland, Canada, from UTC −4 to UTC −3. This same process continues throughout the year, enabling the watch 500 to be a 100% accurate, mechanical, fully automated world time watch.

In some embodiments, the watch 500 incorporates an alternative UTC display 502 and an alternative city selection indicator 504 located around the outside of the watch case and bezel as shown in FIG. 18C. FIG. 18B illustrates a further optional feature of the watch 500 in which the back cover provides a full listing of all displayed cites and their corresponding abbreviation that can be used as a guide in deciphering all of the acronyms.

Figure 20:
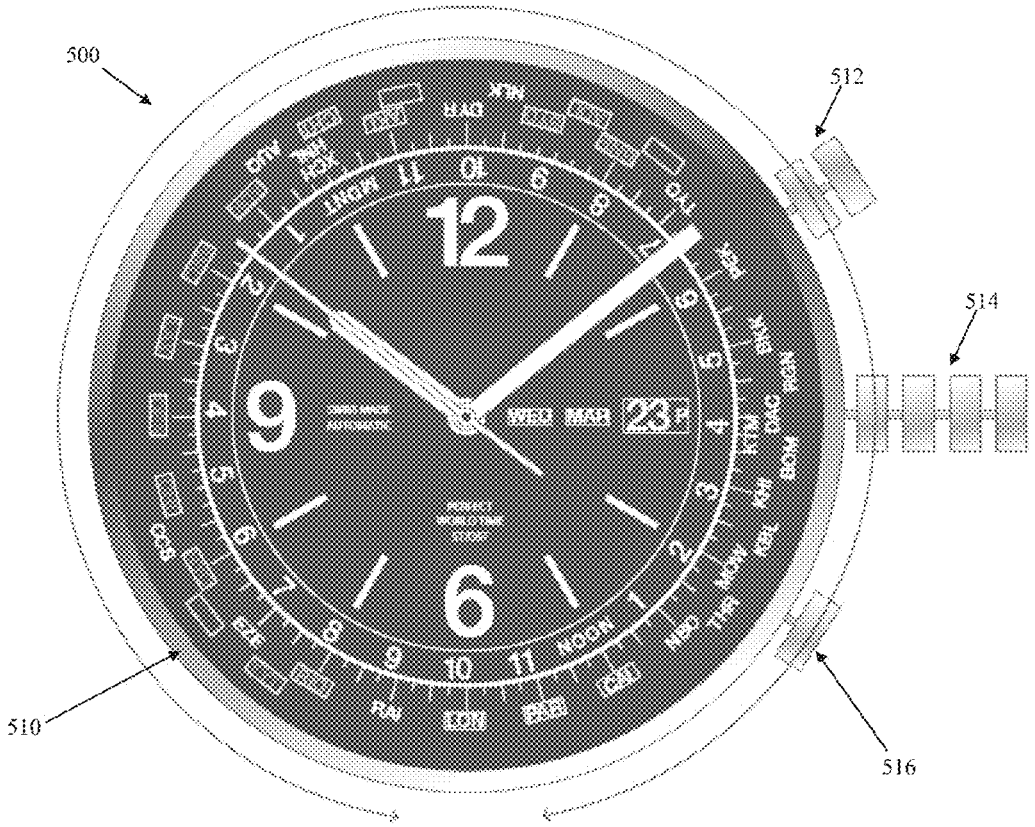
FIG. 20 depicts setting of the watch of FIG. 18A by a user.

FIG. 20 illustrates one technique for setting a current time with some embodiments of the watch 500. First, a bezel 510 (optionally another component) of the watch 500 is rotated to bring the current or selected city to the six o'clock position ("LON" in FIG. 20) or other position as highlighted by the city selection indicator 504 (FIG. 18C) where provided. Crowns 512, 514 are operated by the user to enter and "set" the time, date, and AM/PM displayed by the watch 500. Finally, crown 516 is operated by the user to "set" daylight savings time. In this regard, the watch 500 mechanically (or electronically) "counts" backward from the now-entered current date to determine number of Sundays passed and the number of Sundays yet to come in the current month. For example, if the day/date is "Wednesday, March 23" the crown 516 will rotate three revolutions, counting down to the most-recent Sunday (Sunday, March 20), then the crown 516 will rotate two more revolutions, skip-counting by 7 (13, 6) determining that at this current date, three Sundays have passed in March. The movement mechanisms provided with the watch 500 "knows" that March has thirty-one days, and thus that one more Sunday is yet to occur in current month of March. The movement mechanisms provided with the watch 500 then adjusts to the corresponding world wide daylight savings time state (e.g., state 3 as shown in FIG. 19).

Figure 21A:
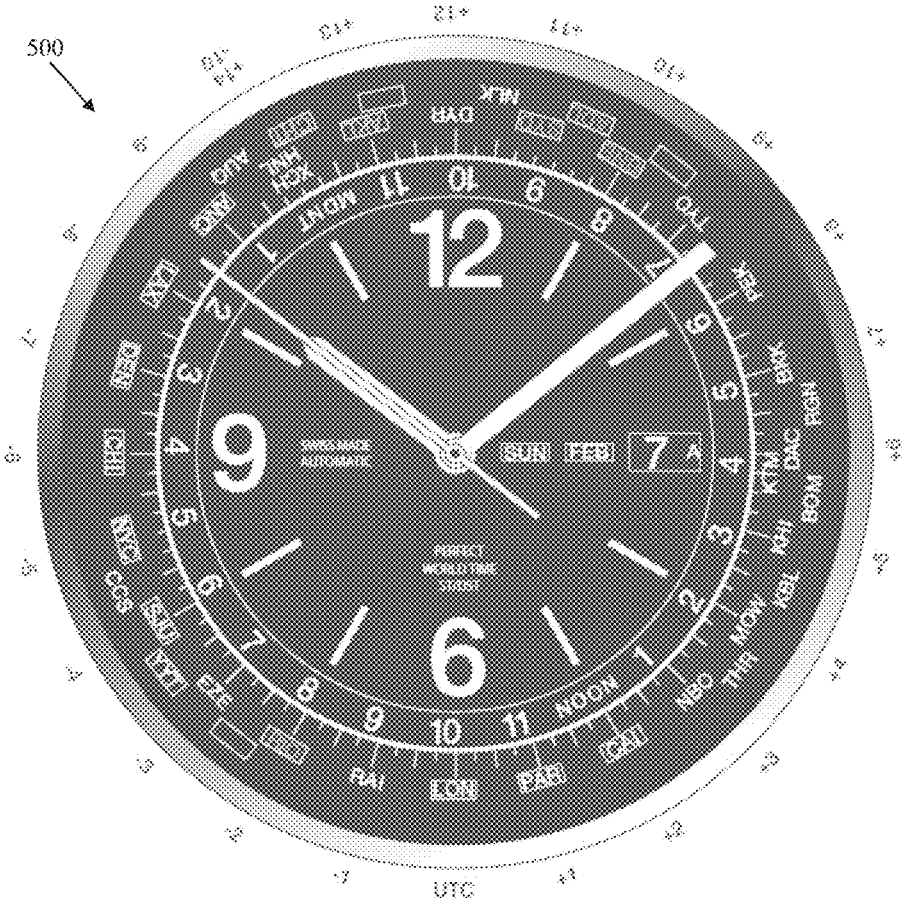
FIGS. 21A-21I are front views of the watch of FIG. 18A and illustrate various automated operations over time.

FIGS. 21A-21I illustrate automatic transitioning of the watch 500 upon occurrence of various daylight savings time events throughout the year. FIG. 21A provides an arbitrary starting point, showing a display of the watch 500 on Sunday, February 7. As a point of reference, the first Sunday of November through the third Sunday in February, the United States and Canada are at standard time, while many cities in the southern hemisphere observe daylight savings time.

Figure 21B:
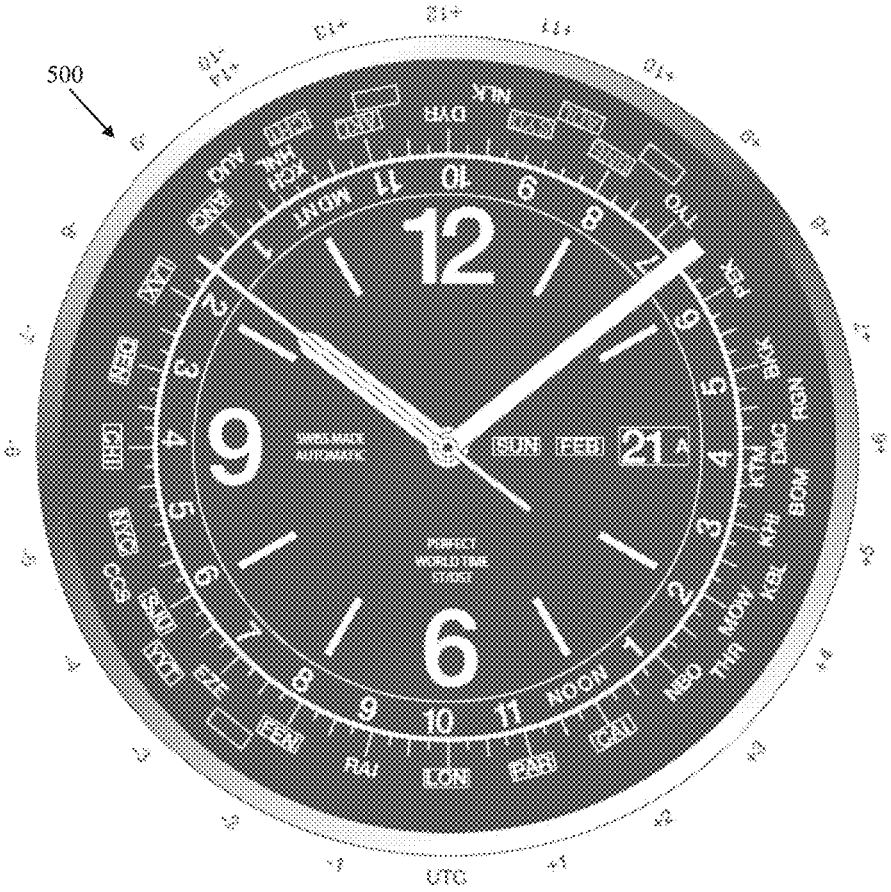

FIG. 21B illustrates a display of the watch 500 at a later point in time, and in particular Sunday, February 21. As a point of reference, the end of February brings standard time back to various locales, such as Brazil; daylight savings time continues on in Australia and New Zealand. A comparison of FIG. 21B with FIG. 21A reveals the automated changes effectuated by the watch 500 in the displayed time of day and UTC offset for certain cities.

Figure 21C:
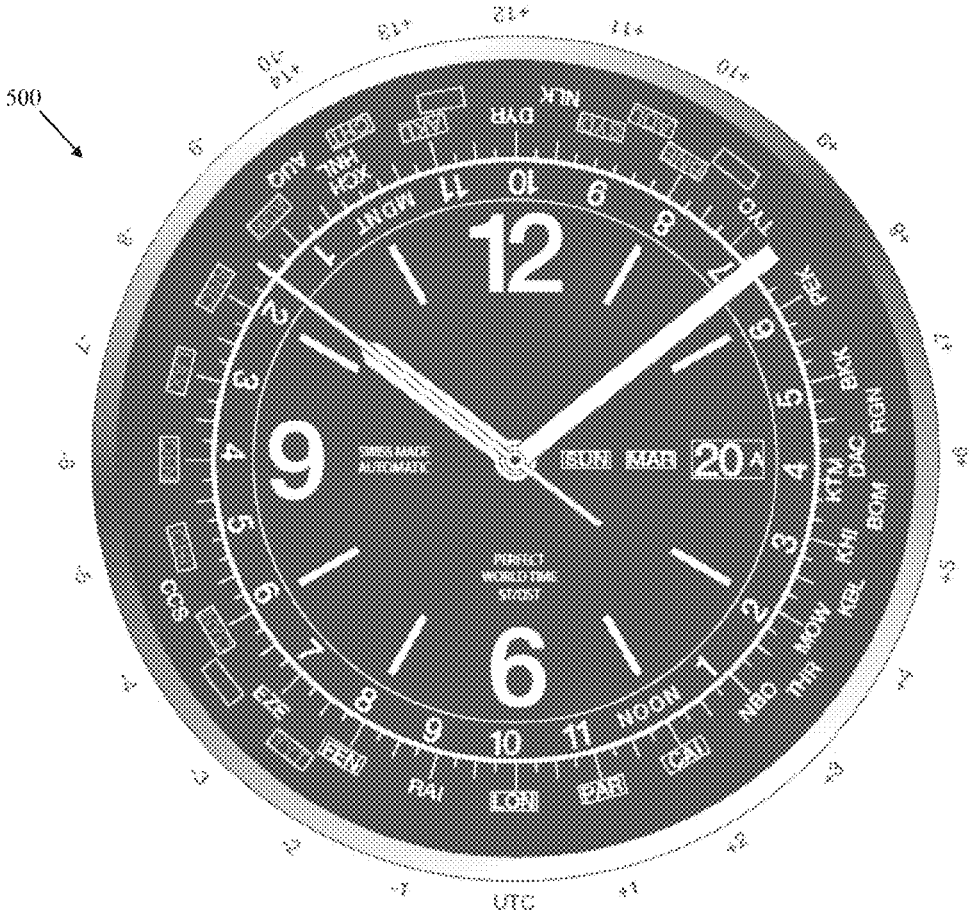

FIG. 21C illustrates a display of the watch 500 at a later point in time, and in particular Sunday, March 20. As a point of reference, at the second Sunday in March, most cities in the United States and Canada invoke daylight savings time. A comparison of FIG. 21C with FIG. 21B reveals the automated changes effectuated by the watch 500 in the displayed time of day and UTC offset for certain cities.

Figure 21D:
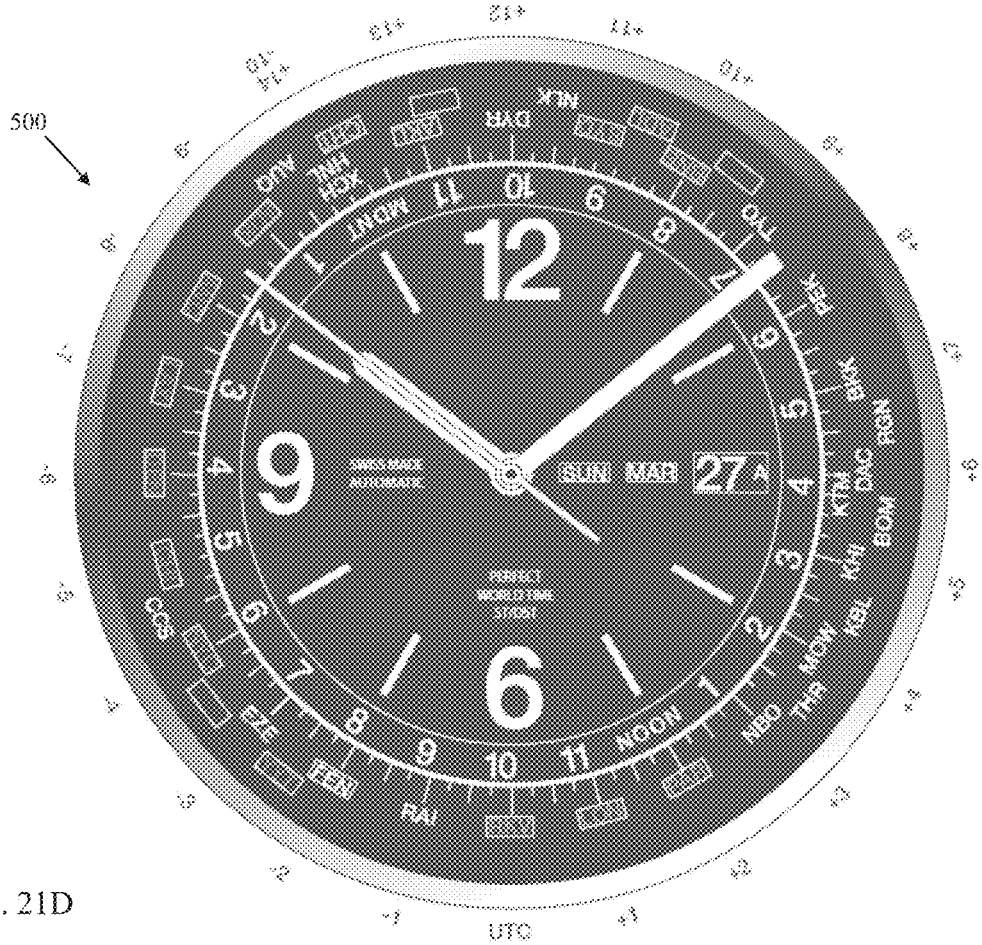

FIG. 21D illustrates a display of the watch 500 at a later point in time, and in particular Sunday, March 27. As a point of reference, most cities in Europe invoke daylight savings time on the last Sunday in March. A comparison of FIG. 21D with FIG. 21C reveals the automated changes effectuated by the watch 500 in the displayed time of day and UTC offset for certain cities.

Figure 21E:
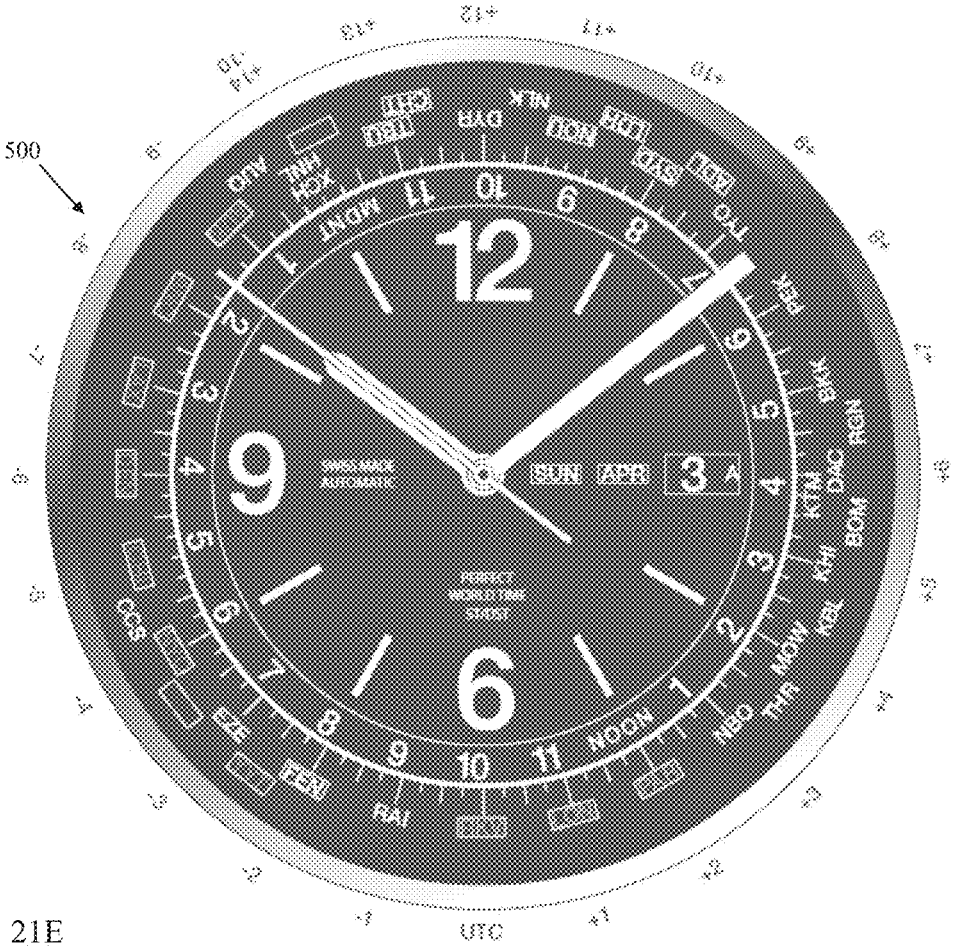

FIG. 21E illustrates a display of the watch 500 at a later point in time, and in particular Sunday, April 3. As a point of reference, most cities in Australia and New Zealand return to standard time on the first Sunday in April. A comparison of FIG. 21E with FIG. 21D reveals the automated changes effectuated by the watch 500 in the displayed time of day and UTC offset for certain cities.

Figure 21F:
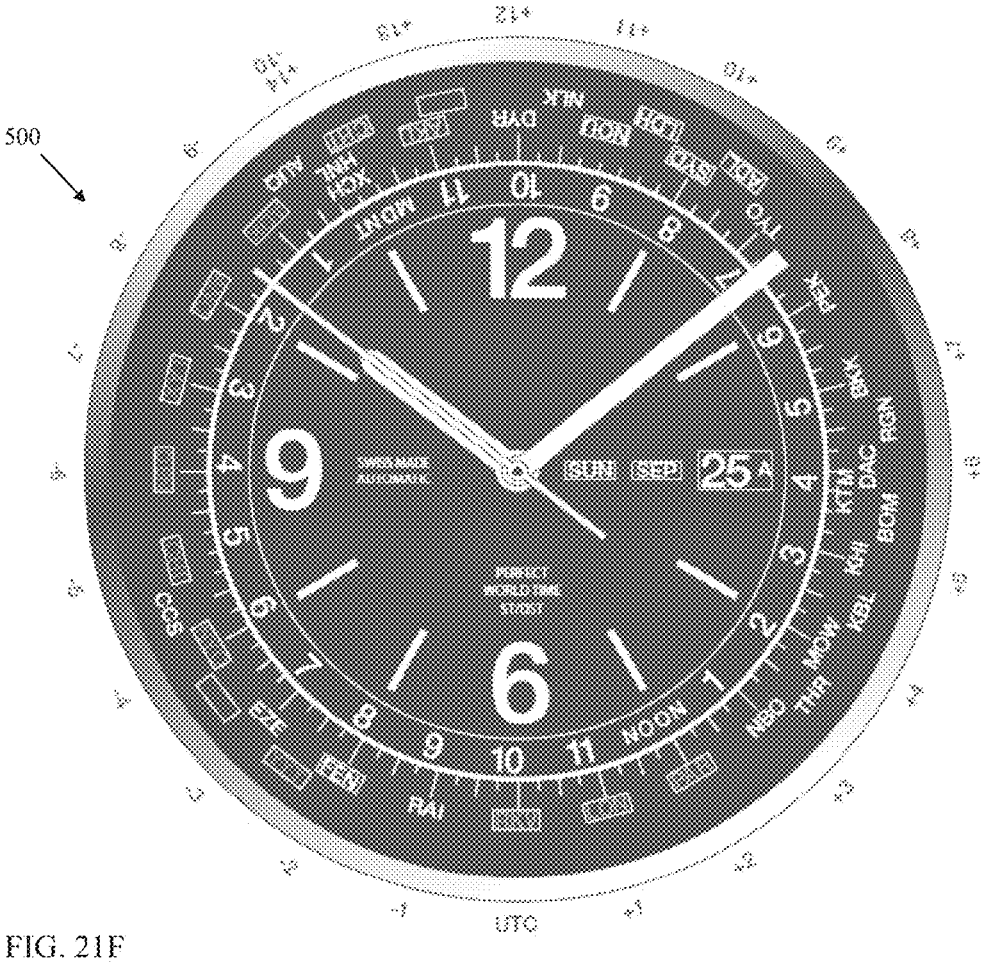

FIG. 21F illustrates a display of the watch 500 at a later point in time, and in particular Sunday, September 25. As a point of reference, daylight savings time begins in New Zealand on the last Sunday in September. A comparison of FIG. 21F with FIG. 21E reveals the automated changes effectuated by the watch 500 in the displayed time of day and UTC offset for certain cities.

Figure 21G:
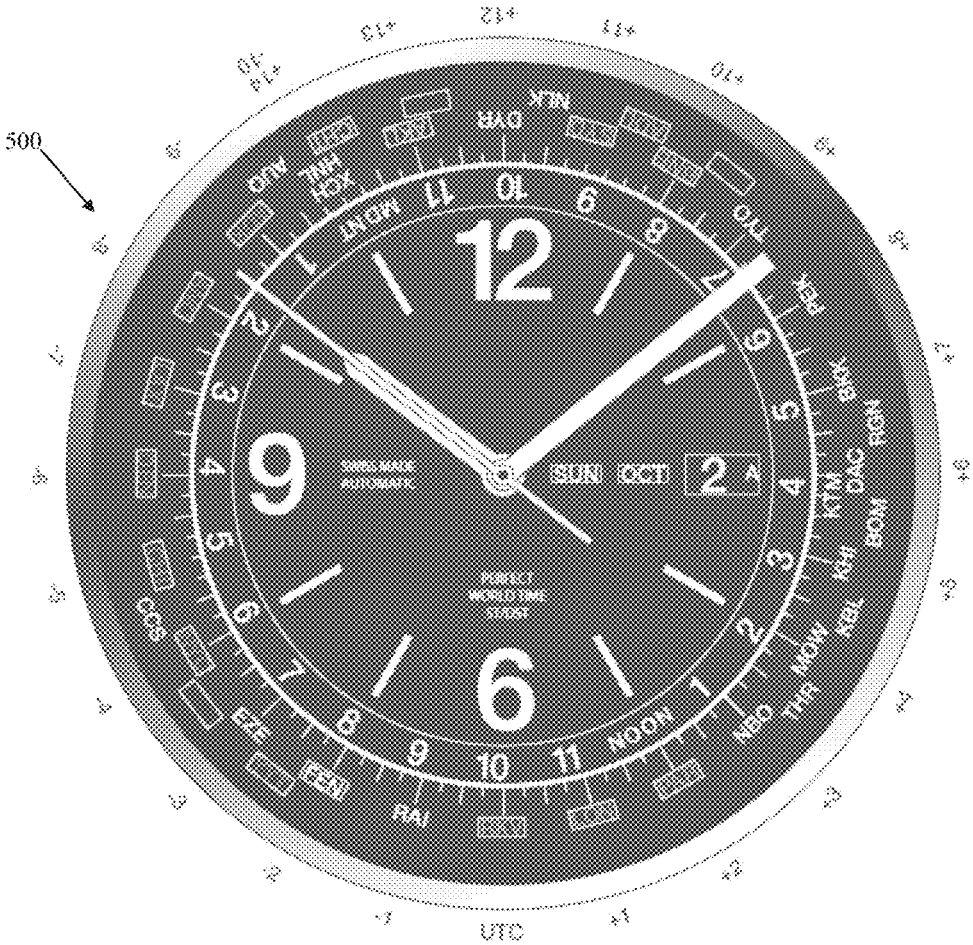

FIG. 21G illustrates a display of the watch 500 at a later point in time, and in particular Sunday, October 2. As a point of reference, daylight savings time begins in Australia on the first Sunday in October. A comparison of FIG. 21G with FIG. 21F reveals the automated changes effectuated by the watch 500 in the displayed time of day and UTC offset for certain cities.

Figure 21H:
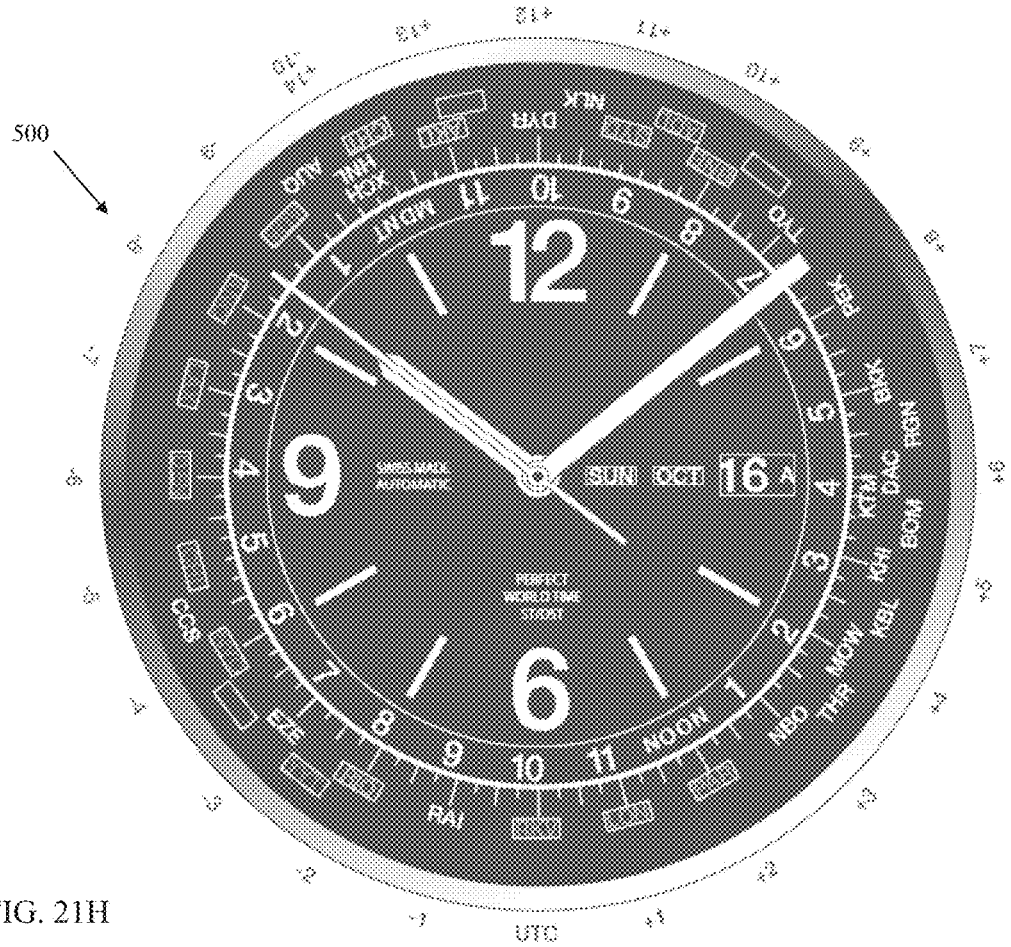

FIG. 21H illustrates a display of the watch 500 at a later point in time, and in particular Sunday, October 16. As a point of reference, daylight savings time begins in Brazil on the third Sunday in October. A comparison of FIG. 21H with FIG. 21G reveals the automated changes effectuated by the watch 500 in the displayed time of day and UTC offset for certain cities.

Figure 21I:
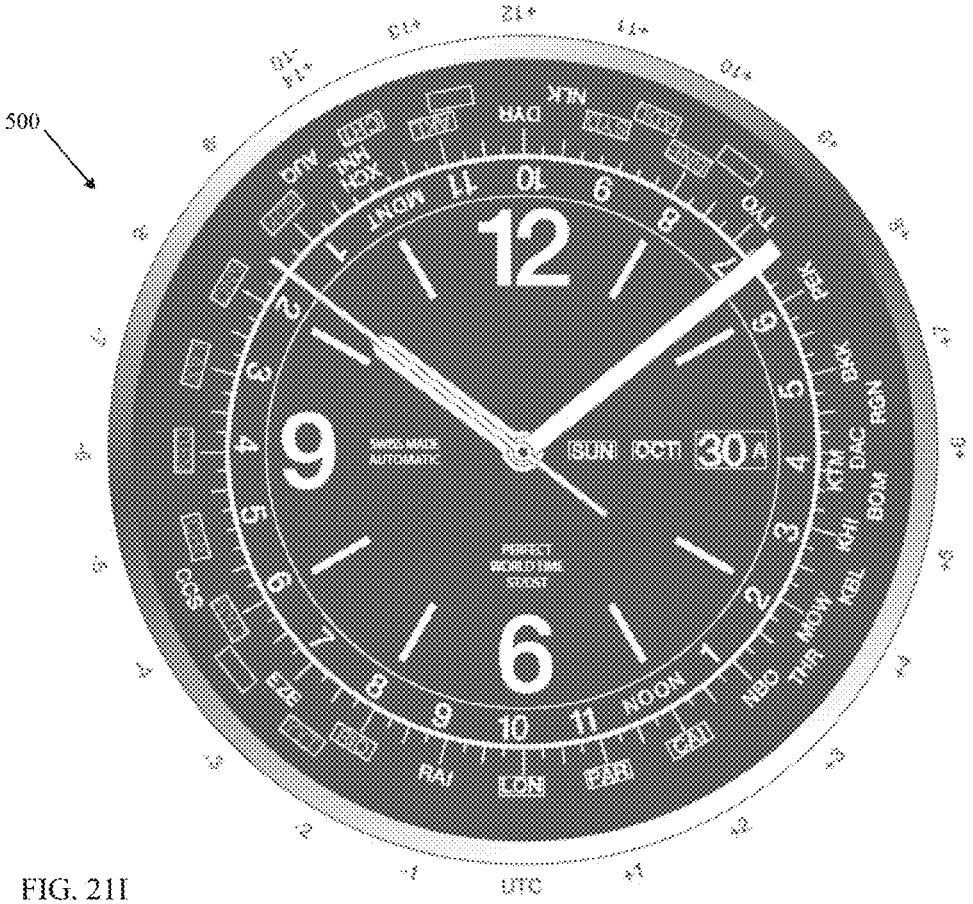

FIG. 21I illustrates a display of the watch 500 at a later point in time, and in particular Sunday, October 30. As a point of reference, daylight savings ends in most cities in Europe on the last Sunday in October. A comparison of FIG. 21I with FIG. 21H reveals the automated changes effectuated by the watch 500 in the displayed time of day and UTC offset for certain cities.

Non-limiting examples of a first display ring 550, a second display ring 552, and first-fifth partial city rings 554*a*-554*e* useful with the watch 500 (or with the watch 20' (FIG. 1B) are provided in FIG. 22. As a point of reference, the second display ring 552 includes hour indicia 556 akin to previous embodiments. With the exemplary configuration of FIG. 22, the hour indicia 556 includes differentiators between midnight and noon (e.g., "MDNT" hour indicia 556*a* and "NOON" hour indicia 556*b*) as described above, as well as differentiators between morning and evening (e.g., "AM" hour indicia 556*c* and "PM" hour indicia 556*d*). The morning and evening differentiators can assume other formats (e.g., "DUSK" and "DAWN"), and can be incorporated into any other embodiment of the present disclosure.

Figure 23A:
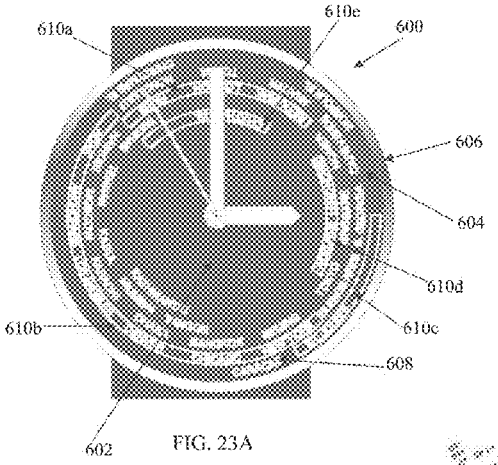
FIG. 23A is a front view of another world watch in accordance with principles of the present disclosure.
Figure 23B:
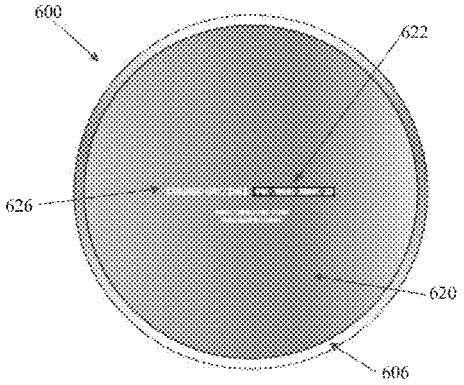
FIG. 23B is a rear view of the watch of FIG. 23A.
Figure 23C:
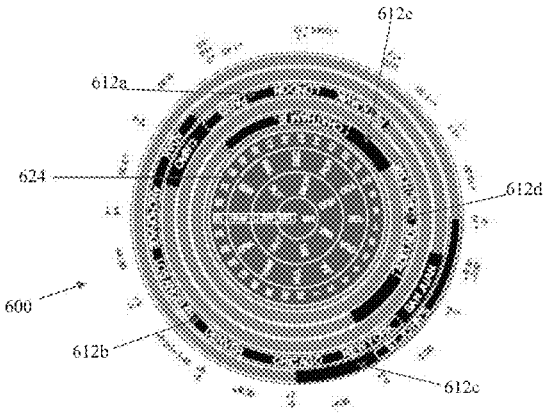
FIG. 23C is a front view of the watch of FIG. 23A with portions removed.

Another embodiment of a world watch 600 in accordance with principles of the present disclosure is shown in FIGS. 23A-23C. As a point of reference, FIG. 23A is a front view of the watch 600 and FIG. 23B is a rear view. FIG. 23C is a front view of the watch 600 with various front face display components removed, along with a representation of indicia display along a side of the watch 600. The watch 600 is akin to other embodiments of the present disclosure, and generally includes a controller apparatus (not shown) configured (e.g., programmed) to automatically effectuate changes in information displayed at a face of the watch 600 in response to various events (e.g., a daylight savings time event, user-prompted change in set time, date or selected time zone city).

The watch 600 includes a primary display 602, a display ring 604 and a bezel 606. As with previous embodiments, the display ring 604 displays city indicia 608 and defines city apertures 610*a*-610*e* through which information provided on partial city rings 612*a*-612*e* can be viewed.

As best shown in FIG. 23B, a back face 620 of the watch 600 forms a selection aperture 622. With additional reference to FIG. 23C, information provided by interior rings 624 (collectively referenced) is visible through the selection aperture 622 (e.g., AM/PM and date information). As a point of reference, because the view of FIG. 23C is taken from a front side of the watch 600 and FIG. 23B is from the back side, the information on the interior rings 624 is "reversed" in FIG. 22C (and would not otherwise be visible in the view of FIG. 23C as the information is "behind" or on the "back side" of the interior rings 624). Finally, city selection indicia 626 can be displayed on the back face 620 in close proximity to the selection aperture 622, readily informing the user as to the particular city or locale to which the watch 600 is to be set (e.g., "CHICAGO").

With the above construction, a user "sets" the watch 600 to the designated city (i.e., the city selection indicia 626) by rotating the bezel 606 (or other component such as a designated crown) to display the current AM/PM and date information in the selection aperture 622 for the designated city 626. The current time is shown at the front display as with previous embodiments.

Although the present disclosure has been described with reference to preferred embodiments, workers skilled in the art will recognize that changes can be made in form and detail without departing from the spirit and scope of the present disclosure.

What is claimed is:

1. A world watch comprising:

a housing;

a primary time display;

a city indicator;

a first member carrying a first set of city indicia;

a second member carrying a second set of city indicia differing from the first set of city indicia;

a plurality of UTC off-set indicia;

wherein the first and second members are arranged relative to the plurality of UTC off-set indicia to visually correlate at least one city indicia of the first and second sets with a particular one of the UTC off-set indicia;

an input feature for selecting a city; and a controller apparatus programmed to:

prompt an update of the primary time display when a time zone corresponding with the selected city reaches a date and time condition that warrants a shift into or out of daylight savings time, prompt movement of the first and second members independent of one another, automatically change a relationship of the first member relative to the plurality of UTC off-set indicia upon reaching a first date and time condition that implicates a daylight savings time event for the locales implicated by the first set of city indicia.

2. The world watch of claim 1, wherein the primary time display includes a primary display carrying hour indicia, a minute hand and an hour hand, the minute and hour hands rotating relative to the primary display to indicate a time of day, and further wherein the controller apparatus is programmed to prompt automatic rotation of the hour hand relative to the display upon the selected city reaching the date and time condition that warrants a shift into or out of daylight savings time.

3. The world watch of claim 2, wherein the controller apparatus is mechanically linked to at least the hour hand.

4. The world watch of claim 1, wherein the controller apparatus is programmed to automatically prompt the primary time display to display a current local time for the selected city.

5. The world watch of claim 1, wherein the controller apparatus is programmed to automatically change a relationship of the second member relative to the plurality of UTC off-set indicia upon reaching a second date and time condition that implicates a daylight savings time event for the locales implicated by the second set of city indicia.

6. The world watch of claim 5, wherein the controller apparatus is programmed to not prompt a change in the relationship of the second member relative to the plurality of UTC off-set indicia upon reaching the first date and time condition under circumstances where the first date and time condition does not implicate a daylight savings time event for the locales implicated by the second set of city indicia.

7. The world watch of claim 6, wherein the controller apparatus is programmed to not prompt a change in the relationship of the first member relative to the plurality of UTC off-set indicia upon reaching the second date and time condition under circumstances where the second date and time condition does not implicate a daylights saving time event for the locales implicated by the first set of city indicia.

8. The world watch of claim 1, wherein the first and second members are rotatable relative to the plurality of UTC off-set indicia.

9. The world watch of claim of claim 1, further comprising a third member carrying a third set of city indicia differing from the first and second sets of city indicia, wherein the controller apparatus is programmed to prompt movement of the third member independent of the first and second members.

10. The world watch of claim 1, wherein the first and second members are selected from the group consisting of a ring and a partial ring.

11. The world watch of claim 1, wherein the primary time display includes a primary display carrying primary hour indicia, a minute hand and an hour hand, the minute and hour hands rotating relative to the primary display to indicate a time of day, the world watch further comprising a secondary time display carrying a plurality of secondary hour indicia, wherein the first and second members are arranged relative to the plurality of secondary time indicia to visually correlate at least one city indicia of the first and second sets with a particular one of the secondary hour indicia.

12. The world watch of claim 11, wherein the controller apparatus is programmed to automatically change a relationship of the first member relative to the plurality of secondary hour indicia upon reaching the first date and time condition.

13. The world watch of claim 12, wherein the world watch is configured such that the controller apparatus prompts at least one of rotation of the first member relative to the secondary hour indicia and rotation of the secondary hour indicia relative to the first member upon reaching the first date and time condition.

14. The world watch of claim 1, further comprising a secondary display member visually associated with the primary time display and forming a plurality of apertures, wherein the first and second members are disposed below the secondary display member, and further wherein the world watch is configured to selectively align individual ones of the city indicia with respective ones of the apertures.

15. The world watch of claim 14, wherein the controller apparatus is programmed to automatically change a relationship of the first member relative to the secondary display member upon reaching the first date and time condition.

16. The world watch of claim 15, wherein the world watch is configured such that the controller apparatus prompts at least one of rotation of the first member relative to the secondary display member and rotation of the secondary display member relative to the first member upon reaching the first date and time condition.

17. The world watch of claim 1, further comprising a date display, wherein the controller apparatus programmed to prompt an update of the date display when a newly selected city implicates a change in date.

18. A world watch comprising:

a housing;

a primary time display including a primary display carrying primary hour indicia, a minute hand and an hour hand, the minute and hour hands rotating relative to the primary display to indicate a time of day;

a secondary time display carrying a plurality of secondary hour indicia;

a city indicator;

a first member carrying a first set of city indicia;

a second member carrying a second set of city indicia differing from the first set of city indicia;

wherein the first and second members are arranged relative to the plurality of secondary time indicia to visually correlate at least one city indicia of the first and second sets with a particular one of the secondary hour indicia;

an input feature for selecting a city; and a controller apparatus programmed to:

prompt an update of the primary time display when a time zone corresponding with the selected city reaches a date and time condition that warrants a shift into or out of daylight savings time, prompt movement of the first and second members independent of one another.

19. A world watch comprising:

a housing;

a primary time display;

a city indicator;

a first member carrying a first set of city indicia;

a second member carrying a second set of city indicia differing from the first set of city indicia;

a secondary display visually associated with the primary time display and forming a plurality of apertures, wherein the first and second members are disposed below the secondary display member, and further wherein the world watch is configured to selectively align individual ones of the city indicia with respective ones of the apertures;

an input feature for selecting a city; and a controller apparatus programmed to:

prompt an update of the primary time display when a time zone corresponding with the selected city reaches a date and time condition that warrants a shift into or out of daylight savings time, prompt movement of the first and second members independent of one another.

20. The world watch of claim 19, wherein the controller apparatus is programmed to automatically change a relationship of the first member relative to the secondary display member upon reaching a first date and time condition that implicates a daylight savings time event for the locales implicated by the first set of city indicia.

* * * * *